US011037578B2

(12) United States Patent
Beack et al.

(10) Patent No.: US 11,037,578 B2
(45) **Date of Patent: *Jun. 15, 2021**

(54) ENCODER AND ENCODING METHOD FOR MULTI-CHANNEL SIGNAL, AND DECODER AND DECODING METHOD FOR MULTI-CHANNEL SIGNAL

(71) Applicant: Electronics and Telecommunications Research Institute, Daejeon (KR)

(72) Inventors: Seung Kwon Beack, Daejeon (KR); Tae Jin Lee, Daejeon (KR); Jong Mo Sung, Daejeon (KR); Jeong Il Seo, Daejeon (KR); Kyeong Ok Kang, Daejeon (KR); Dae Young Jang, Daejeon (KR); Jin Woong Kim, Daejeon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 0 days.

This patent is subject to a terminal disclaimer.

(21) Appl. No.: 16/126,964

(22) Filed: Sep. 10, 2018

(65) Prior Publication Data

US 2019/0005971 A1 Jan. 3, 2019

Related U.S. Application Data

(63) Continuation of application No. 15/620,119, filed on Jun. 12, 2017, now Pat. No. 10,102,863, which is a (Continued)

(30) Foreign Application Priority Data

Apr. 10, 2013 (KR) ..... 10-2013-0039272
Jul. 5, 2013 (KR) ..... 10-2013-0079230

(Continued)

(51) Int. Cl.
*H04S 3/00* (2006.01)
*G10L 19/008* (2013.01)

(52) U.S. Cl.
CPC ..... *G10L 19/008* (2013.01); *H04S 3/008* (2013.01); *H04S 2400/03* (2013.01)

(58) Field of Classification Search
CPC ..... G10L 12/008; H04S 3/008; H04S 2400/03

(Continued)

(56) References Cited

U.S. PATENT DOCUMENTS 7,751,572 B2 * 7/2010 Villemoes ..... G10L 19/008 381/23
2003/0084277 A1 * 5/2003 Przywara ..... G10L 19/00 713/1

(Continued)

FOREIGN PATENT DOCUMENTS

KR 1020070091562 A 9/2007
KR 1020100095586 A 8/2010

(Continued)

OTHER PUBLICATIONS

"Information technology—High efficiency coding and media delivery in heterogeneous environments—Part 3: 3D audio", Apr. 4, 2014, ISO/IEC JTC 1/SC 29 N, ISO/IEC CD 23008-3, ISO/IEC JTC 1/SC 29/WG 11.*

(Continued)

*Primary Examiner* — Melur Ramakrishnaiah
(74) *Attorney, Agent, or Firm* — William Park & Associates Ltd.

(57) ABSTRACT

An encoder and an encoding method for a multi-channel signal, and a decoder and a decoding method for a multi-channel signal are disclosed. A multi-channel signal may be efficiently processed by consecutive downmixing or upmixing.

3 Claims, 20 Drawing Sheets

Related U.S. Application Data continuation of application No. 14/783,767, filed as application No. PCT/KR2014/003126 on Apr. 10, 2014, now Pat. No. 9,679,571.

(30) Foreign Application Priority Data

Sep. 3, 2013 (KR) ..... 10-2013-0105727
Oct. 15, 2013 (KR) ..... 10-2013-0122638
Apr. 10, 2014 (KR) ..... 10-2014-0042972

(58) Field of Classification Search
USPC ..... 381/22, 23
See application file for complete search history.

(56) References Cited

U.S. PATENT DOCUMENTS

2003/0236583 A1 12/2003 Baumgarte et al.
2006/0165237 A1* 7/2006 Villemoes ..... G10L 19/008 381/20
2007/0121954 A1* 5/2007 Kim ..... H04S 3/002 381/22
2008/0091436 A1* 4/2008 Breebaart ..... H04S 5/005 704/500
2009/0164221 A1 6/2009 Kim et al.
2009/0287494 A1* 11/2009 Pang ..... H04S 3/008 704/500
2010/0284550 A1 11/2010 Oh et al.
2010/0310081 A1 12/2010 Lien et al.
2011/0046964 A1 2/2011 Moon et al.
2011/0091045 A1 4/2011 Schuijers et al.
2015/0179180 A1* 6/2015 Oh ..... G10L 19/008 381/22

FOREIGN PATENT DOCUMENTS

KR 1020110016668 A 2/2011
KR 1020110018728 A 2/2011
KR 1020130029253 A 3/2013

OTHER PUBLICATIONS

"Information technology—MPEG audio technologies—Part 3: Unified speech and audio coding", Sep. 20, 2011, ISO/IEC JTC 1/SC 29, ISO/IEC FDIS 23003-3:2011(E), ISO/IEC JTC 1/SC 29/WG 11.
Johannes Hilpert et al., "Description of the Fraunhofer IIS Submission for the 3D-Audio CfP", Fraunhofer IIS, International Organization for Standardization Organisation Internationale Normalisation, ISO/IEC JTC 1/SC 29/WG 11, Coding of Moving Pictures and Audio, Aug. 2013, pp. 1-10, Vienna, Austria.
Jürgen Herre et al., "MPEG Surround—The ISO/MPEG Standard for Efficient and Compatible Multichannel Audio Coding*", MPEG Surround—Multichannel Audio Coding, J. Audio Eng. Soc., Nov. 2008, pp. 932-955, vol. 56, No. 11.

* cited by examiner

ENCODER AND ENCODING METHOD FOR MULTI-CHANNEL SIGNAL, AND DECODER AND DECODING METHOD FOR MULTI-CHANNEL SIGNAL

CROSS-REFERENCE TO RELATED APPLICATION

The present application is a continuation application of U.S. patent application Ser. No. 15/620,119, filed on Jun. 12, 2017, which is incorporated herein by reference in its entirety.

TECHNICAL FIELD

The present invention relates to an encoder and an encoding method for a multi-channel signal, and a decoder and a decoding method for a multi-channel signal, and more particularly to a codec for efficiently processing a multi-channel signal of a plurality of channel signals.

BACKGROUND ART

MPEG Surround (MPS) is an audio codec for coding a multi-channel signal, such as a 5.1 channel and a 7.1 channel, which is an encoding and decoding technique for compressing and transmitting the multi-channel signal at a high compression ratio. MPS has a constraint of backward compatibility in encoding and decoding processes. Thus, a bitstream compressed via MPS and transmitted to a decoder is required to satisfy a constraint that the bitstream is reproduced in a mono or stereo format even with a previous audio codec.

Accordingly, even though a number of input channels forming a multi-channel signal increases, a bitstream transmitted to a decoder needs to include an encoded mono signal or stereo signal. The decoder may further receive additional information so as to upmix the mono signal or stereo signal transmitted through the bitstream. The decoder may reconstruct the multi-channel signal from the mono signal or stereo signal using the additional information.

Ultimately, audio compressed in the MPS format represents the mono or stereo format and thus is reproducible even with a general audio codec, not by an MPS decoder, based on backward compatibility.

In recent years, audio-video (AV) equipment is required to process ultrahigh-quality audio. Accordingly, a novel technology for compressing and transmitting ultrahigh-quality audio is needed. For ultrahigh-quality audio, faithful rendering of sound quality and sound field of the original audio is more important than backward compatibility. For instance, 22.2-channel audio, which is for reproducing an ultrahigh-quality audio sound field, needs a high-quality multi-channel coding technique which enables sound quality and sound field effects of the original audio to be rendered even by the decoder as they are, rather than a compression and transmission technique which provides backward compatibility, such as MPS.

MPS is an audio coding technique which is capable of basically processing 5.1-channel audio while providing backward compatibility. Thus, MPS downmixes a multi-channel signal and analyzes the downmixed signal to render a mono signal or stereo signal. Additional information, obtained in the analysis process, is a spatial cue, and the decoder may upmix the mono signal or stereo signal using the spatial cue to reconstruct the original multi-channel signal.

Here, the decoder generates a decorrelated audio signal at upmixing so as to reproduce a sound field rendered by the original multi-channel signal. The decoder may reproduce a sound field effect of the multi-channel signal using the decorrelated audio signal. The decorrelated audio signal is necessary for reproducing a width or depth of the sound field of the original multi-channel signal. The decorrelated audio signal may be generated by applying a filtering operation to the downmixed signal in the mono or stereo format transmitted from an encoder.

A process that the decoder reconstructs 5.1-channel audio using MPS upmixing will be described below. Equation 1 is an upmixing matrix.

$$\begin{bmatrix} L_{synth} \\ R_{synth} \\ Ls_{synth} \\ Rs_{synth} \\ C_{synth} \end{bmatrix} = \underbrace{\begin{bmatrix} a_{11} & a_{12} & a_{13} & a_{14} & a_{15} \\ a_{21} & a_{22} & a_{23} & a_{24} & a_{25} \\ a_{31} & a_{32} & a_{33} & a_{34} & a_{35} \\ a_{41} & a_{42} & a_{43} & a_{44} & a_{45} \\ a_{51} & 0 & 0 & 0 & 0 \end{bmatrix}}_{upmixing\ matrix} \begin{bmatrix} m_0 \\ dm_0^0 \\ dm_0^1 \\ dm_0^2 \\ dm_0^3 \end{bmatrix} \quad \text{[Equation 1]}$$

In Equation 1, the upmixing matrix may be generated based on a spatial cue transmitted from the encoder. Inputs of the upmixing matrix include a downmixed signal $m_0$ and signals decorrelated from the downmixed signal. $dm'_0$, generated from {L, R, Ls, Rs, C}. That is, original multi-channel signals {Lsynth, Rsynth, LSsynth, RSsynth} may be reconstructed by applying the upmixing matrix in Equation 1 to the downmixed signal $m_0$ and the decorrelated signals $dm'_0$.

Here, when sound field effects of the original multi-channel signals are reproduced through MPS, a problem may arise. In detail, as described above, the decoder uses a decorrelated signal for reproducing sound field effects of a multi-channel signal. However, since the decorrelated signals are artificially generated from the downmixed signal $m_0$ in the mono format, sound quality of the reconstructed multi-channel signals may deteriorate with higher dependency on the decorrelated signals for the sound field effects of the multi-channel signals.

In particular, when the multi-channel signals are reconstructed by MPS, a plurality of decorrelated signals is needed. When the downmixed signal transmitted from the encoder is a mono format, a plurality of decorrelated signals is necessarily used to render the sound field of the original multi-channel signals from the downmixed signal. Thus, when the original multi-channel signals are reconstructed through mono downmixing, it is possible to achieve compression efficiency and to reproduce the sound field at a certain level, while sound quality may deteriorate.

That is, using the conventional MPS method has a limit in reconstructing an ultrahigh-quality multichannel signal. To overcome such a limit, the encoder may transmit a residual signal to the decoder to replace a decorrelated signal with the residual signal. However, transmitting a residual signal is inefficient in compression efficiency as compared with transmitting the original channel signal.

DISCLOSURE OF INVENTION

Technical Goals

An aspect of the present invention provides a coding method using minimum decorrelation signals for reconstructing a high-quality multi-channel signal considering a basic concept of MPEG Surround (MPS).

Another aspect of the present invention provides a coding method for efficiently processing four channel signals.

Technical Solutions

According to an aspect of the present invention, there is provided a method of encoding a multi-channel signal including outputting a first channel signal and a second channel signal by downmixing four channel signals using a first two-to-one (TTO) downmixing unit and a second TTO downmixing unit; outputting a third channel signal by downmixing the first channel signal and the second channel signal using a third TTO downmixing unit; and generating a bitstream by encoding the third channel signal.

The outputting of the first channel signal and the second channel signal may output the first channel signal and the second channel signal by downmixing a channel signal pair forming the four channel signals using the first TTO downmixing unit and the second TTO downmixing unit disposed in parallel.

The generating of the bitstream may include extracting a core band of the third channel signal corresponding to a low-frequency band by removing a high-frequency band; and encoding the core band of the third channel signal.

According to another aspect of the present invention, there is provided a method of encoding a multi-channel signal including generating a first channel signal by downmixing two channel signals using a first TTO downmixing unit; generating a second channel signal by downmixing two channel signals using a second TTO downmixing unit; and stereo-encoding the first channel signal and the second channel signal.

One of the two channel signals downmixed by the first downmixing unit and one of the two channel signals downmixed by the second downmixing unit may be swapped channel signals.

One of the first channel signal and the second channel signal may be a swapped channel signal.

One of the two channel signals downmixed by the first downmixing unit may be generated by a first stereo spectral band replication (SBR) unit, another thereof may be generated by a second stereo SBR unit, one of the two channel signals downmixed by the second downmixing unit may be generated by the first stereo SBR unit, and another thereof may be generated by the second stereo SBR unit.

According to an aspect of the present invention, there is provided a method of decoding a multi-channel signal including extracting a first channel signal by decoding a bitstream; outputting a second channel signal and a third channel signal by upmixing the first channel signal using a first one-to-two (OTT) upmixing unit; outputting two channel signals by upmixing the second channel signal using a second OTT upmixing unit; and outputting two channel signals by upmixing the third channel signal using a third OTT upmixing unit.

The outputting of the two channel signals by upmixing the second channel signal may upmix the second channel signal using a decorrelation signal corresponding to the second channel signal, and the outputting of the two channel signals by upmixing the third channel signal may upmix the third channel signal using a decorrelation signal corresponding to the third channel signal.

The second OTT upmixing unit and the third OTT upmixing unit may be disposed in parallel to independently conduct upmixing.

The extracting of the first channel signal by decoding the bitstream may include reconstructing the first channel signal of a core band corresponding to a low-frequency band by decoding the bitstream; and reconstructing a high-frequency band of the first channel signal by expanding the core band of the first channel signal.

According to another aspect of the present invention, there is provided a method of decoding a multi-channel signal including reconstructing a mono signal by decoding a bitstream; outputting a stereo signal by upmixing the mono signal in an OTT manner; and outputting four channel signals by upmixing a first channel signal and a second channel signal forming the stereo signal in a parallel OTT manner.

The outputting of the four channel signals may output the four channel signals by upmixing in the OTT manner using the first channel signal and a decorrelation signal corresponding to the first channel signal and by upmixing in the OTT manner using the second channel signal and a decorrelation signal corresponding to the second channel signal.

According to still another aspect of the present invention, there is provided a method of decoding a multi-channel signal including outputting a first downmixed signal and a second downmixed signal by decoding a channel pair element using a stereo decoding unit; outputting a first upmixed signal and a second upmixed signal by upmixing the first downmixed signal using a first upmixing unit; and outputting a third upmixed signal and a fourth upmixed signal by upmixing the second downmixed signal which is swapped using a second upmixing unit.

The method may further include reconstructing high-frequency bands of the first upmixed signal and the third upmixed signal which is swapped using a first band extension unit; and reconstructing high-frequency bands of the second upmixed signal which is swapped and the fourth upmixed signal using a second band extension unit.

According to yet another aspect of the present invention, there is provided a method of decoding a multi-channel signal including outputting a first downmixed signal and a second downmixed signal by decoding a first channel pair element using a first stereo decoding unit; outputting a first residual signal and a second residual signal by decoding a second channel pair element using a second stereo decoding unit; outputting a first upmixed signal and a second upmixed signal by upmixing the first downmixed signal and the first residual signal which is swapped using a first upmixing unit; and outputting a third upmixed signal and a fourth upmixed signal by upmixing the second downmixed signal which is swapped and the second residual signal using a second upmixing unit.

According to an aspect of the present invention, there is provided a multi-channel signal encoder including a first downmixing unit to output a first channel signal by downmixing a pair of two channel signals among four channel signals in the TTO manner; a second downmixing unit to output a second channel signal by downmixing a pair of remaining channel signals among the four channel signals in the TTO manner; a third downmixing unit to output a third channel signal by downmixing the first channel signal and the second channel signal in the TTO manner; and an encoding unit to generate a bitstream by encoding the third channel signal.

According to an aspect of the present invention, there is provided a multi-channel signal decoder including a decoding unit to extract a first channel signal by decoding a bitstream; a first upmixing unit to output a second channel signal and a third channel signal by upmixing the first channel signal in the OTT manner; a second upmixing unit to output two channel signals by upmixing the second channel signal in the OTT manner; and a third upmixing unit to output two channel signals by upmixing the third channel signal in the OTT manner.

According to another aspect of the present invention, there is provided a multi-channel signal decoder including a decoding unit to reconstruct a mono signal by decoding a bitstream; a first upmixing unit to output a stereo signal by upmixing the mono signal in the OTT manner; a second upmixing unit to output two channel signals by upmixing a first channel signal forming the stereo signal; and a third upmixing unit to output two channel signals by upmixing a second channel signal forming the stereo signal, wherein the second upmixing unit and the third upmixing unit are disposed in parallel to upmix the first channel signal and the second channel signal in the OTT manner to output four channels signals.

According to still another aspect of the present invention, there is provided a multi-channel signal decoder including a stereo decoding unit to output a first downmixed signal and a second downmixed signal by decoding a channel pair element; a first upmixing unit to output a first upmixed signal and a second upmixed signal by upmixing the first downmixed signal; and a second upmixing unit to output a third unmixed signal and a fourth upmixed signal by upmixing the second downmixed signal which is swapped.

Effects of Invention

An aspect of the present invention may provide a coding method using minimum decorrelation signals for reconstructing a high-quality multi-channel signal considering a basic concept of MPEG Surround (MPS).

Another aspect of the present invention may provide a coding method for efficiently processing four channel signals.

BEST MODE FOR CARRYING OUT THE INVENTION

Hereinafter, exemplary embodiments will be described in detail with reference to the accompanying drawings.

In the following description, a mono signal means a single channel signal, and a stereo signal means two channel signals. A stereo signal may include two mono signals. Further, N channel signals include a greater number of channels than M channel signals.

Figure 1:
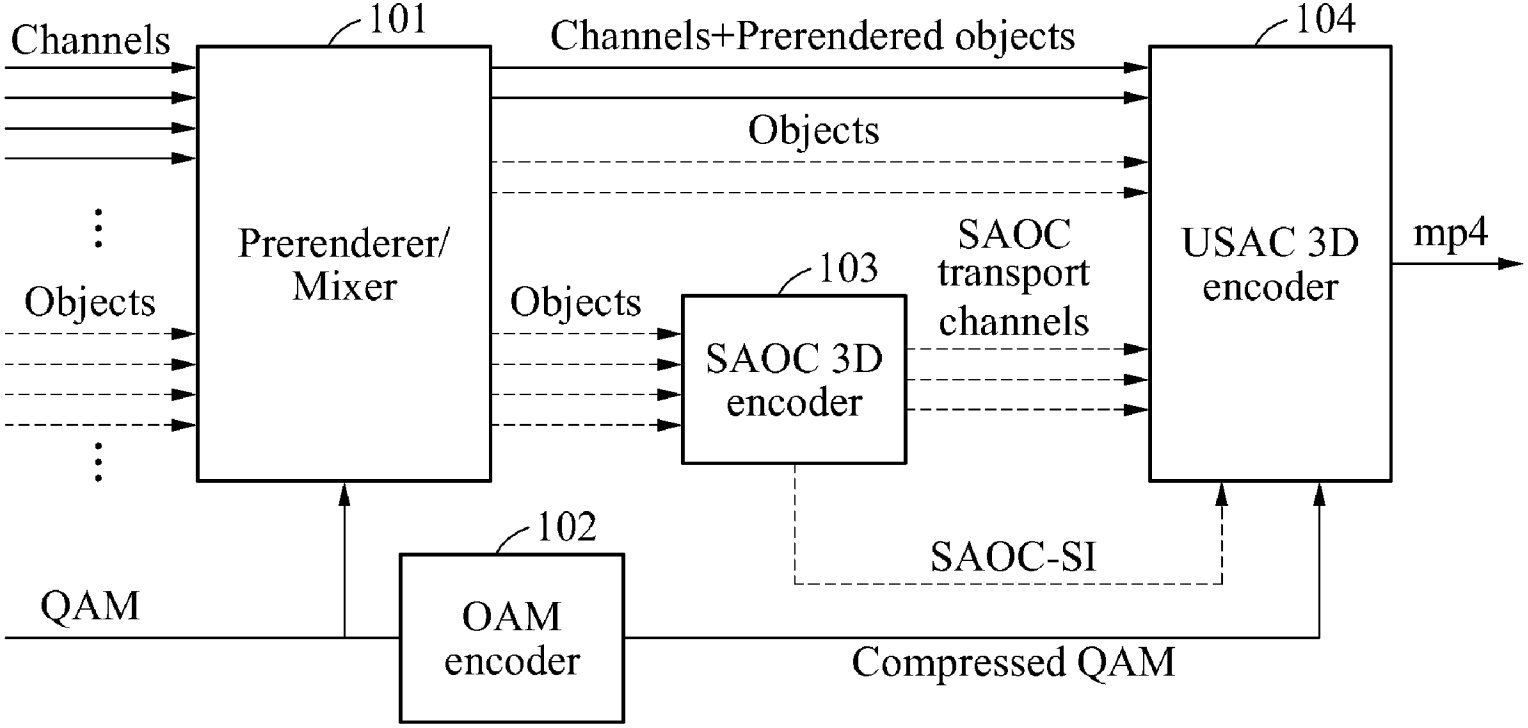
FIG. 1 illustrates a three-dimensional (3D) audio encoder according to an embodiment.

FIG. 1 illustrates a three-dimensional (3D) audio encoder according to an embodiment.

Referring to FIG. 1, the 3D audio encoder may process a plurality of channels and a plurality of objects to generate an audio bitstream. In the 3D audio encoder, a prerenderer/mixer 101 may pre-render the plurality of objects according to a layout of the plurality of channels and transmit the objects to a Unified Speech and Audio Coding (USAC) 3D encoder 104.

That is, the prerenderer/mixer 101 may render the objects by matching the plurality of input objects to the plurality of channels. Here, the prerenderer/mixer 101 may determine a weighting of the objects for each channel using associated object metadata (OAM). Also, the prerenderer/mixer 101 may downmix and transmit the input objects to the USAC 3D encoder 104. The prerenderer/mixer 101 may transmit the input objects to a Spatial Audio Object Coding (SAOC) 3D encoder 103.

An OAM encoder 102 may encode object metadata and transmit the object metadata to the USAC 3D encoder 104.

The SAOC 3D encoder 103 may generate a smaller number of SAOC transmission channels than that of the objects and spatial parameters, OLD, IOC, DMG, or the like, as additional information by rendering the input objects.

The USAC 3D encoder 104 may generate mapping information explaining how to map the input objects and channels to USAC channel elements, such as Channel Pair Elements (CPEs), Single Pair Elements (SPEs) and Low Frequency Enhancements (LFEs).

The USAC 3D encoder 104 may encode at least one of the channels, the objects pre-rendered according to the layout of the channels, the downmixed objects, the compressed object metadata, the SAOC additional information and the SAOC transmission channels, thereby generating a bitstream.

Embodiments to be mentioned below will be described based on the USAAC 3D encoder 104.

Figure 2:
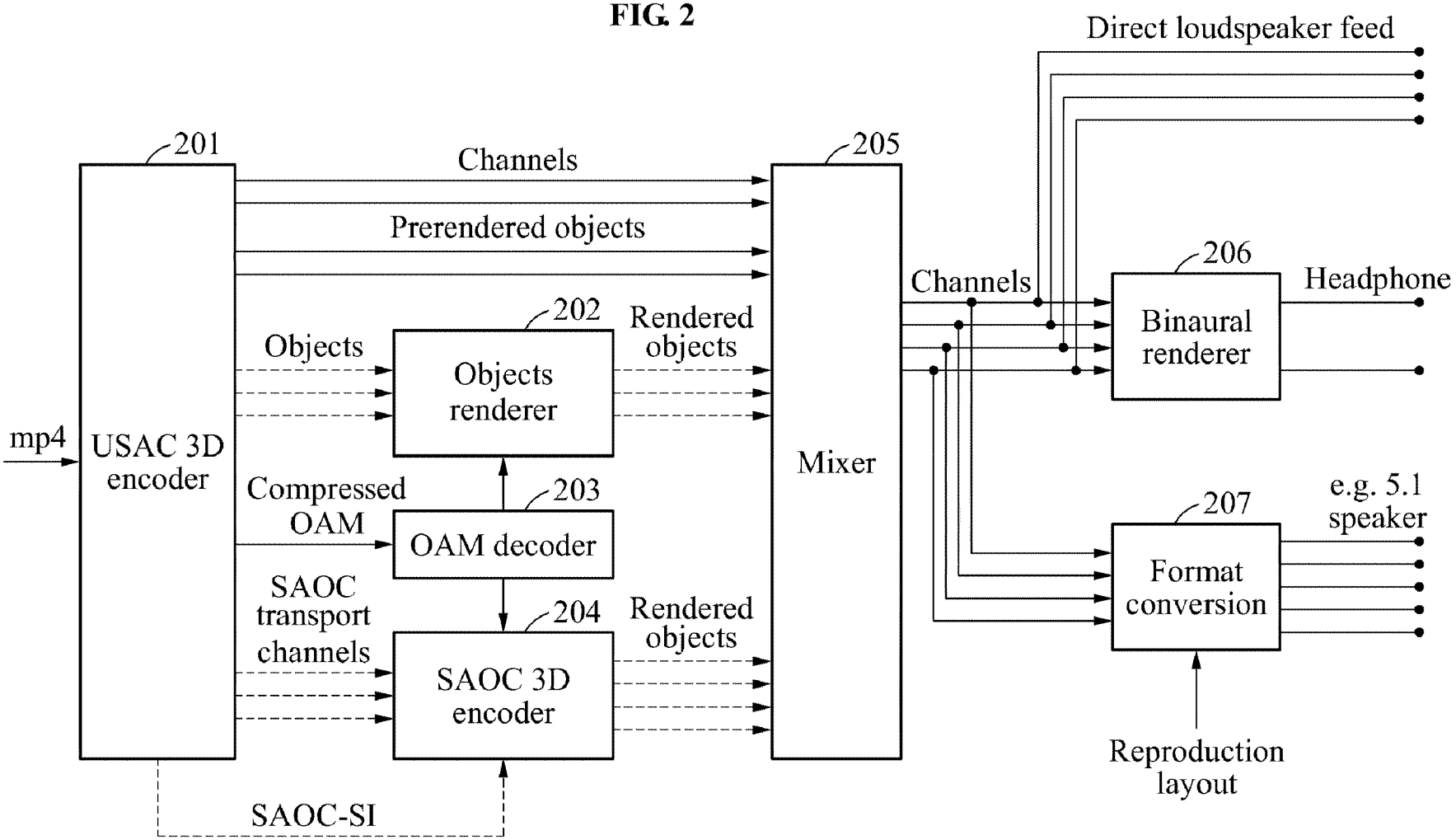
FIG. 2 illustrates a 3D audio decoder according to an embodiment.

FIG. 2 illustrates a 3D audio decoder according to an embodiment.

The 3D audio decoder may receive the bitstream generated by the USAC 3D encoder 104 in the 3D audio encoder. A USAC 3D decoder 201 included in the 3D audio decoder may extract the plurality of channels, the pre-rendered objects, the downmixed objects, the compressed object metadata, the SAOC additional information and the SAOC transmission channels from the bitstream.

An object renderer 202 may render the downmixed objects according to a reproduction format using the object metadata. Accordingly, each object may be rendered to an output channel as the reproduction format according to the object metadata.

An OAM decoder 203 may reconstruct the compressed object metadata.

An SAOC 3D decoder 204 may generate rendered objects using the SAOC transmission channels, the SAOC additional information and the object metadata. Here, the SAOC 3D decoder 204 may upmix an object corresponding to an SAOC transmission channel to increase a number of objects.

A mixer 205 may mix the plurality of channels and the pre-rendered objects transmitted from the USAC 3D decoder 201, the objects rendered by the object renderer 2002, and the objects rendered by the SAOC 3D decoder 204 to output a plurality of channel signals. Subsequently, the mixer 205 may transmit the output channel signals to a binaural renderer 206 and a format conversion unit 207.

The output channel signals may be fed directly to a loudspeaker and reproduced. In this case, a channel number of the channel signals needs to be the same as a channel number supported by the loudspeaker. The output channel signals may be rendered as headphone signals by the binaural renderer 206. When the channel number of the channel signals is different from the channel number supported by the loudspeaker, the format conversion unit 207 may render the channel signals based on a channel layout of the loudspeaker. That is, the format conversion unit 207 may convert a format of the channel signals into a format of the loudspeaker.

Embodiments to be mentioned below will be described based on the USAC 3D decoder 201.

Figure 3:
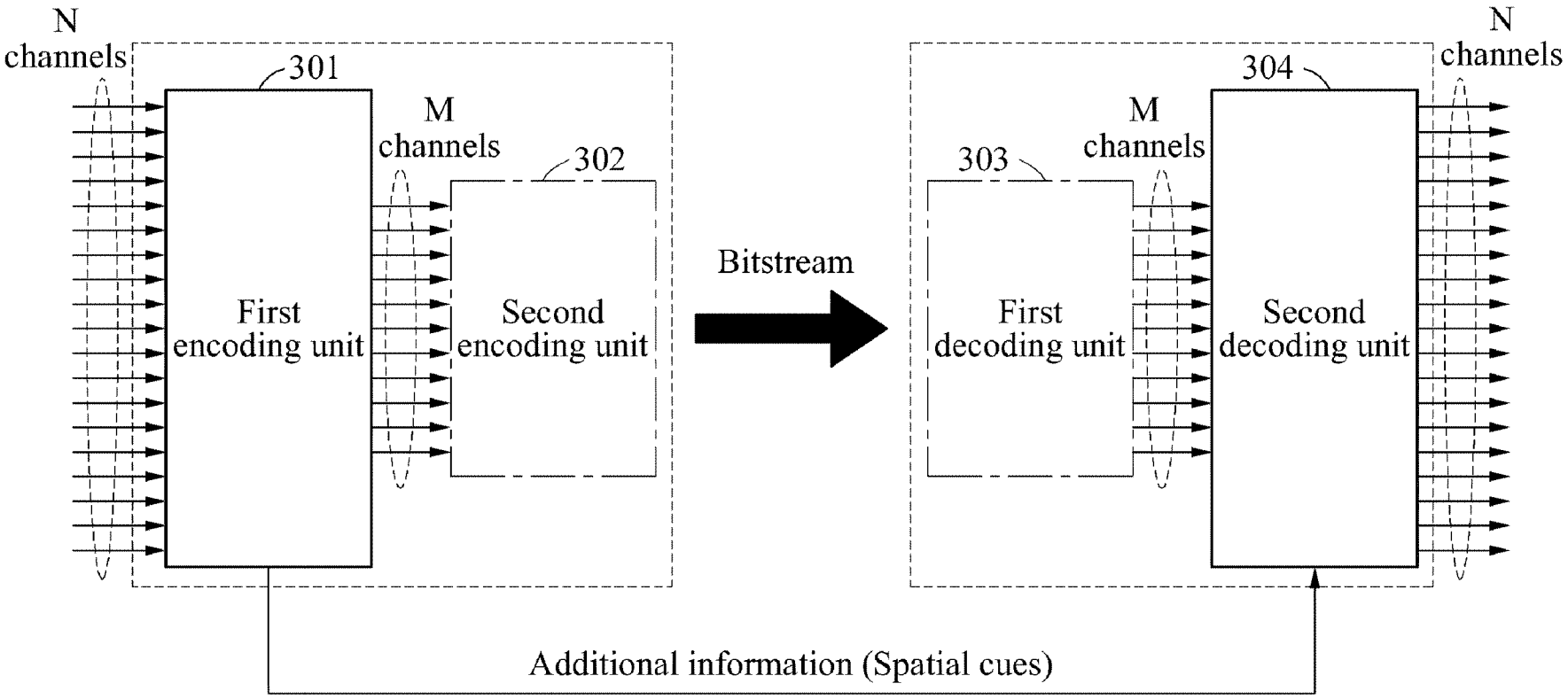
FIG. 3 illustrates a Unified Speech and Audio Coding (USAC) 3D encoder and a USAC 3D decoder according to an embodiment.

FIG. 3 illustrates a USAC 3D encoder and a USAC 3D decoder according to an embodiment.

Referring to FIG. 3, the USAC 3D encoder may include a first encoding unit 301 and a second encoding unit 302. Alternatively, the USAC 3D encoder may include the second encoding unit 302. Likewise, the USAC 3D decoder may include a first decoding unit 303 and a second decoding unit 304. Alternatively, the USAC 3D encoder may include the first decoding unit 303.

N channel signals may be input to the first encoding unit 301. The first encoding unit 301 may downmix the N channel signals to output M channel signals. Here, N may be greater than M. For example, if N is an even number, M may be N/2. Alternatively, if N is an odd number, M may be (N−1)/2+1. That is, Equation 2 may be provided.

$$M = \frac{N}{2} \ (N \text{ is even}), \qquad \text{[Equation 2]}$$

$$M = \frac{N-1}{2} + 1 \ (N \text{ is odd})$$

The second encoding unit 302 may encode the M channel signal to generate a bitstream. For instance, the second encoding unit 302 may encode the M channel signals, in which a general audio coder may be utilized. For example, when the second encoding unit 302 is an Extended HE-AAC USAC coder, the second encoding unit 302 may encode and transmit 24 channel signals.

Here, when the N channel signals are encoded using the second encoding unit 302, relatively greater bits are needed than when the N channel signals are encoded using both the first encoding unit 301 and the second encoding unit 302, and sound quality may deteriorate.

Meanwhile, the first decoding unit 303 may decode the bitstream generated by the second encoding unit 302 to output the M channel signals. The second decoding unit 304 may upmix the M channel signals to output the N channel signals. The second decoding unit 302 may decode the M channel signals to generate a bitstream. For example, the second decoding unit 304 may decode the M channel signals, in which a general audio coder may be utilized. For instance, when the second decoding unit 304 is an Extended HE-AAC USAC coder, the second decoding unit 302 may decode 24 channel signals.

Figure 4:
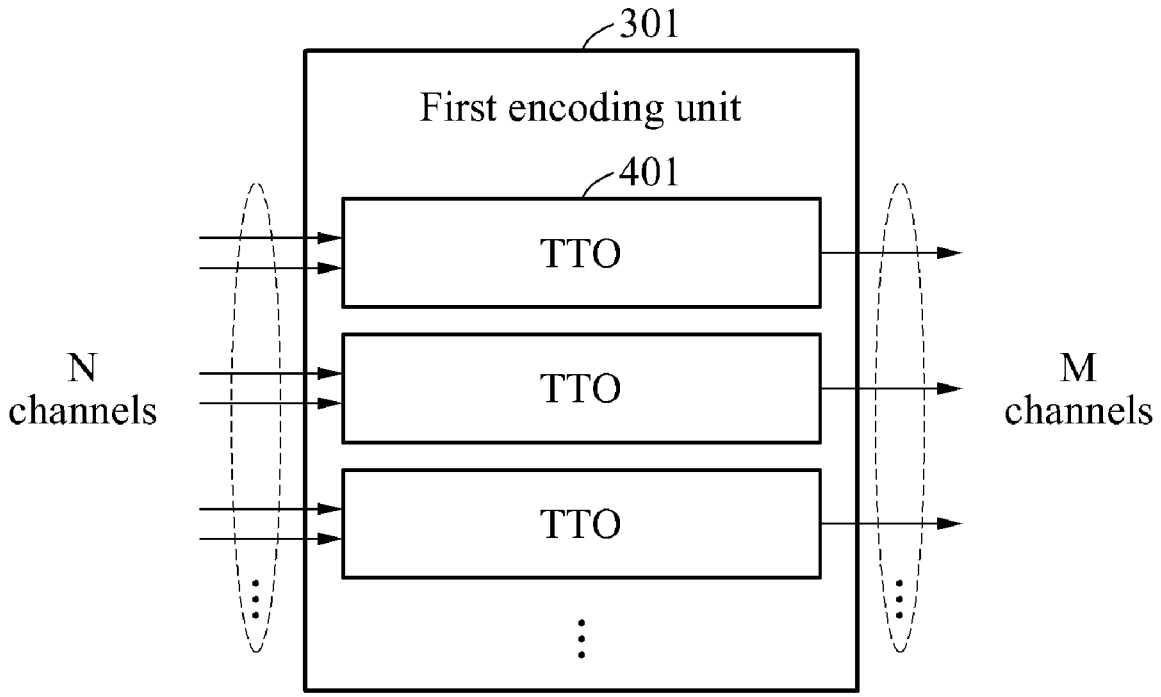
FIG. 4 is a first diagram illustrating a configuration of a first encoding unit of FIG. 3 in detail according to an embodiment.

FIG. 4 is a first diagram illustrating a configuration of the first encoding unit of FIG. 3 in detail according to an embodiment.

The first encoding unit 301 may include a plurality of downmixing units 401. Here, the N channel signals input to the first encoding unit 301 may be input in pairs to the downmixing units 401. The downmixing units 401 may have a two-to-one (TTO) structure. The downmixing units 401 may extract a spatial cue, such as Channel Level Difference (CLD), Inter Channel Correlation/Coherence (ICC), Inter Channel Phase Difference (IPD) or Overall Phase Difference (OPD), from the two input channel signals and downmix the two channel signals to output one channel signal.

The downmixing units 401 included in the first encoding unit 301 may form a parallel structure. For instance, when N channel signals are input to the first encoding unit 301, in which N is an even number, N/2 TTO downmixing units 401 may be needed for the first encoding unit 301.

Figure 5:
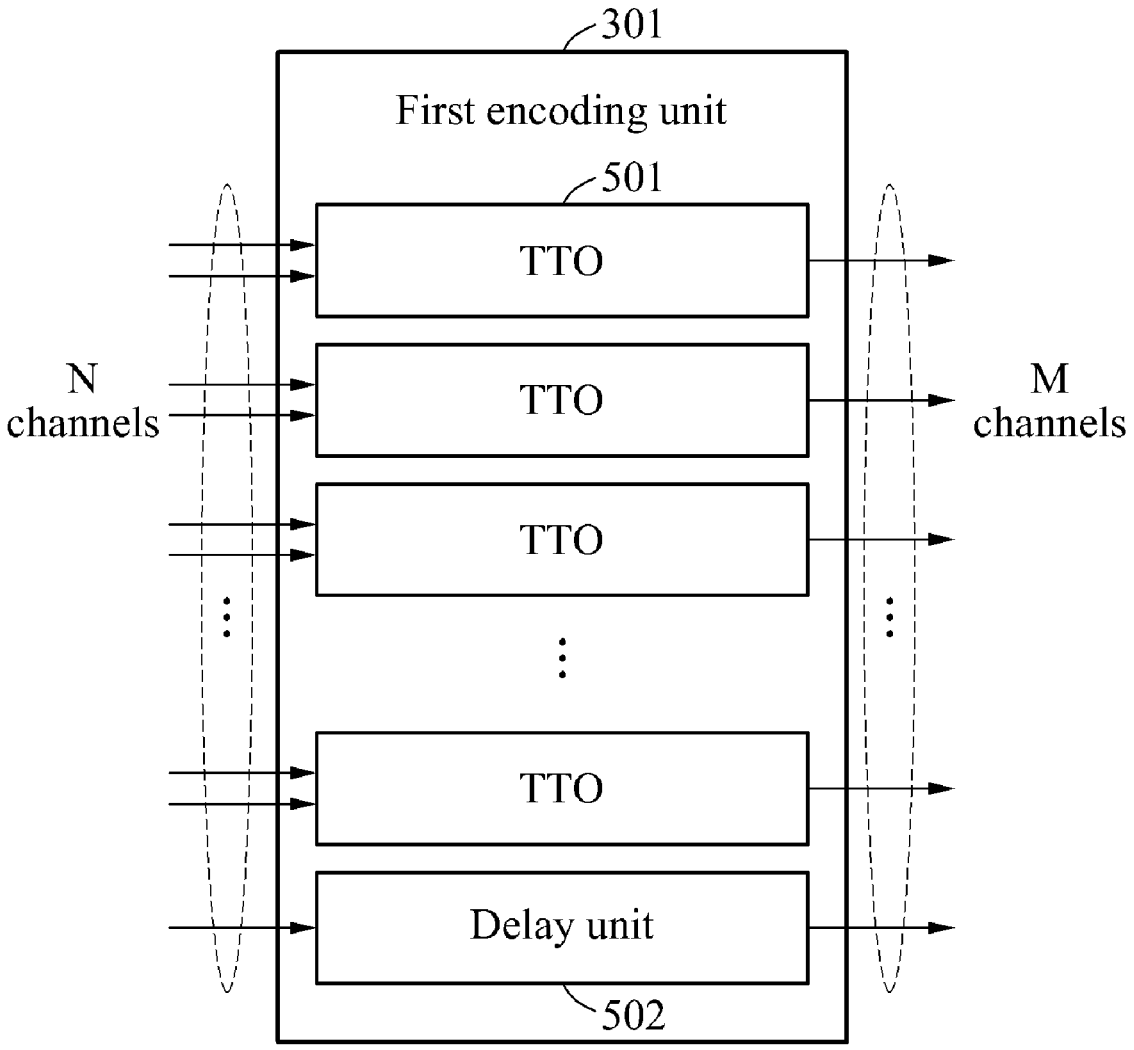
FIG. 5 is a second diagram illustrating a configuration of the first encoding unit of FIG. 3 in detail according to an embodiment.

FIG. 5 is a second diagram illustrating a configuration of the first encoding unit of FIG. 3 in detail according to an embodiment.

FIG. 4 illustrates the detailed configuration of the first encoding unit 301 in when N channel signals are input to the first encoding unit 301, wherein N is an even number. FIG. 5 illustrates the detailed configuration of the first encoding unit 301 when N channel signals are input to the first encoding unit 301, wherein N is an odd number.

Referring to FIG. 5, the first encoding unit 301 may include a plurality of downmixing units 501. Here, the first encoding unit 301 may include (N−1)/2 downmixing units 501. The first encoding unit 301 may include a delay unit 502 for processing one remaining channel signal.

Here, the N channel signals input to the first encoding unit 301 may be input in pairs to the downmixing units 501. The downmixing units 501 may have a TTO structure. The downmixing units 501 may extract a spatial cue, such as CLD, ICC, IPD or OPD, from the two input channel signals and downmix the two channel signals to output one channel signal.

A delay value applied to the delay unit 502 may be the same as a delay value applied to the downmixing units 501. If M channel signals output from the first encoding unit 301 are a pulse-code modulation (PCM) signal, the delay value may be determined according to Equation 3.

Enc_Delay=Delay1(QMF Analysis)+Delay2(Hybrid QMF Analysis)+Delay3(QMF Synthesis) [Equation 3]

Here, Enc_Delay represent the delay value applied to the downmixing units 501 and the delay unit 502. Delay1 (QMF Analysis) represents a delay value generated when quadrature mirror filter (QMF) analysis is performed on 64 hands of an MPS(MPEG Surround), which may be 288. Delay2 (Hybrid QMF Analysis) represents a delay value generated in Hybrid QMF analysis using a 13-tap filter, which may be 6*64=384. Here, 64 is applied, because hybrid QMF analysis is performed after QMF analysis is performed on the 64 bands.

If the M channel signals output from the first encoding unit 301 are a QMF signal, the delay value may be determined according to Equation 4.

Enc_Delay=Delay1(QMF Analysis)+Delay2(Hybrid QMF Analysis) [Equation 4]

Figure 6:
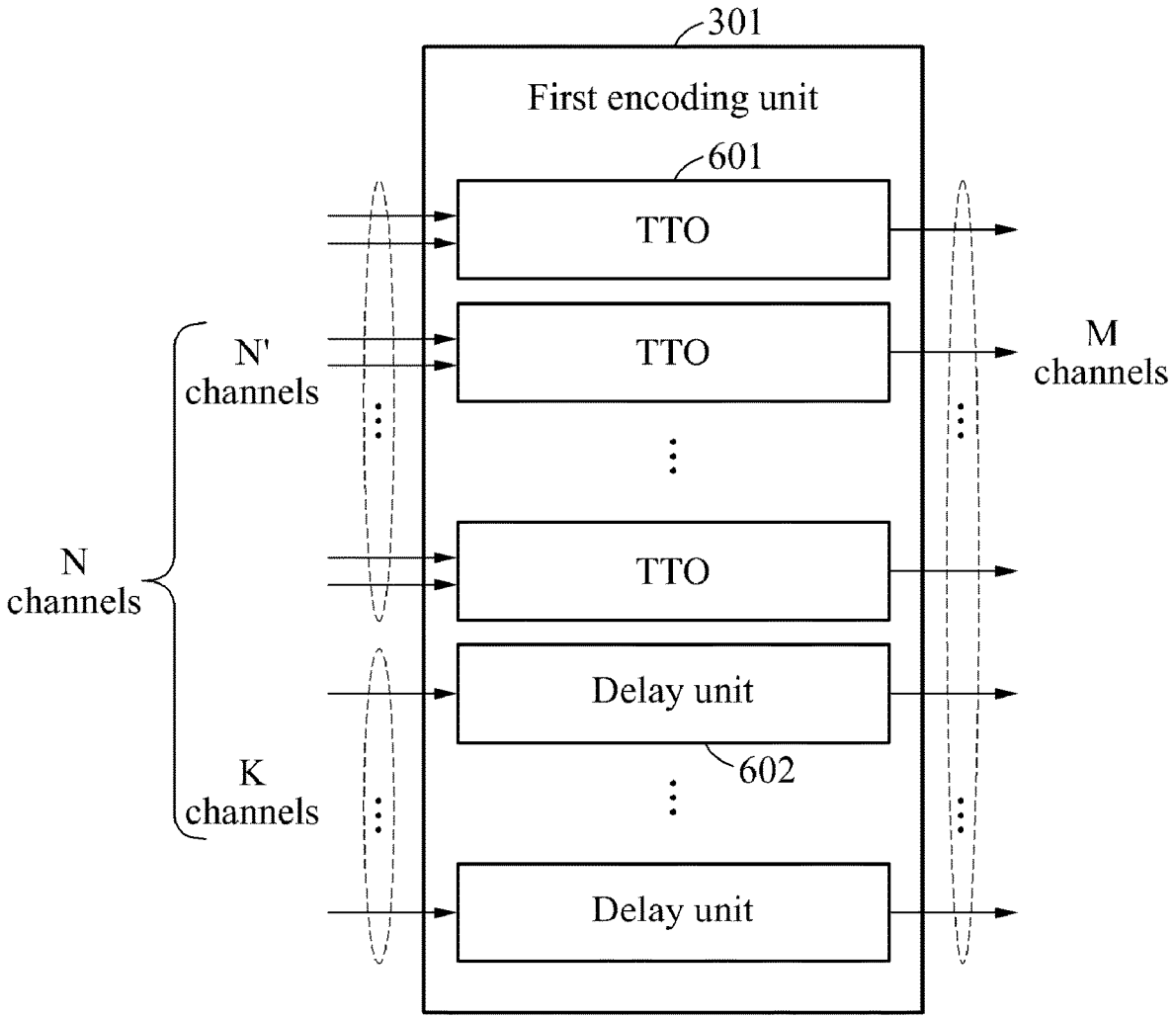
FIG. 6 is a third diagram illustrating a configuration of the first encoding unit of FIG. 3 in detail according to an embodiment.
Figure 7:
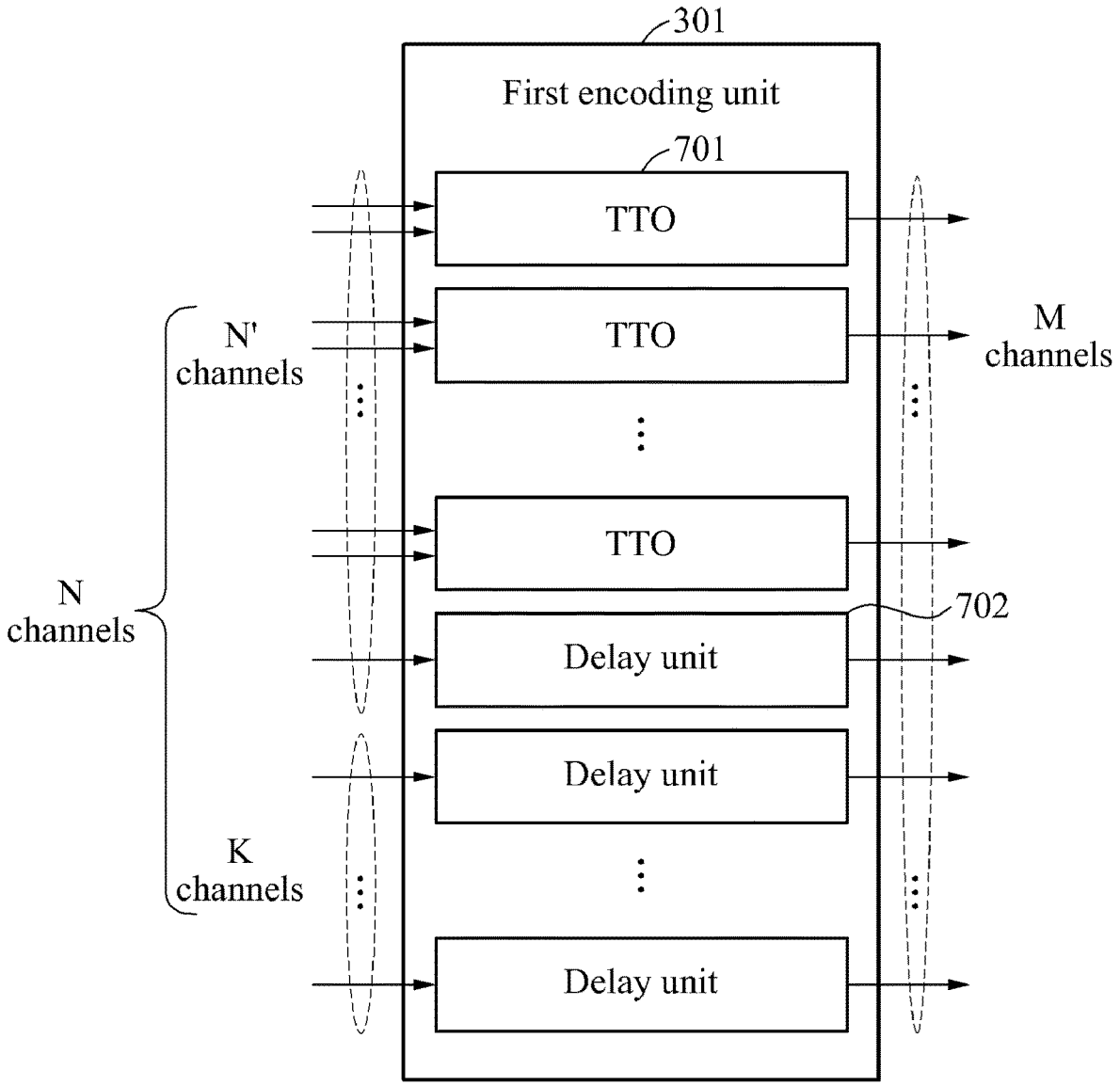
FIG. 7 is a fourth diagram illustrating a configuration of the first encoding unit of FIG. 3 in detail according to an embodiment.

FIG. 6 is a third diagram illustrating a configuration of the first encoding unit of FIG. 3 in detail according to an embodiment. FIG. 7 is a fourth diagram illustrating a configuration of the first encoding unit of FIG. 3 in detail according to an embodiment.

Suppose that N channel signals include N' channel signals and K channel signals. Here, the N' channel signals are input to the first encoding unit 301, but the K channel signals are not input to the first encoding unit 301.

In this case, M, which is applied to M channel signals input to the second encoding unit 302, may be determined by Equation 5.

$$M = \frac{N'}{2} + K \ (N' \text{ is even}), \quad M = \frac{N'-1}{2} + 1 + K \ (N' \text{ is odd}) \qquad \text{[Equation 5]}$$

Here, FIG. 6 illustrates the configuration of the first encoding unit 301 when N' is an even number, while FIG. 7 illustrates the configuration of the first encoding unit 301 when N' is an odd number.

According to FIG. 6, when N' is an even number, the N' channel signals may be input to the downmixing units 601 and the K channel signals may be input to a plurality of delay units 602. Here, the N' channel signals may be input to N'/2 downmixing units 601 having the TTO structure and the K channel signals may include K delay units 602.

According to FIG. 7, when N' is an odd number, the N' channel signals may be input to a plurality of downmixing units 701 and one delay unit 702. The K channel signals may be input to a plurality of delay units 702. Here, the N' channel signals may be input to N/2 downmixing units 701 having the ITO structure and the one delay unit 702. The K channel signals may be input to K delay units 702.

Figure 8:
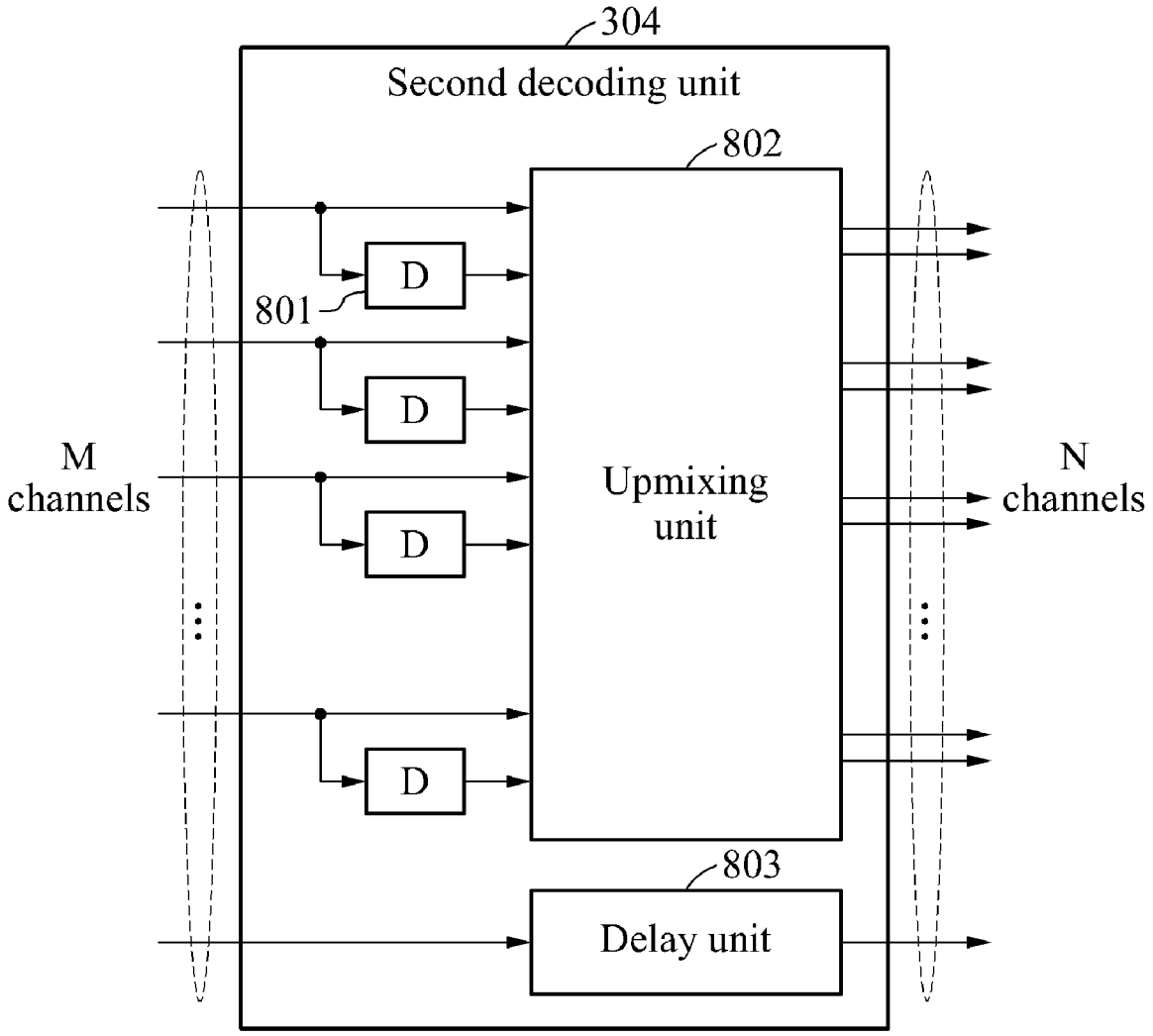
FIG. 8 is a first diagram illustrating a configuration of a second encoding unit of FIG. 3 in detail according to an embodiment.

FIG. 8 is a first diagram illustrating a configuration of the second encoding unit of FIG. 3 in detail according to an embodiment.

Referring to FIG. 8, the second decoding unit 304 may upmix M channel signals transmitted from the first decoding unit 303 to output N channel signals. Here, the second decoding unit 304 may upmix the M channel signals using a spatial cue transmitted from the second encoding unit 301 of FIG. 3.

For instance, when N is an even number in the N channel signals, the second decoding unit 304 may include a plurality of decorrelation units 801 and an upmixing unit 802. When N is an odd number, the second decoding unit 304 may include a plurality of decorrelation units 801, an upmixing unit 802 and a delay unit 803. That is, when N is an even number, the delay unit 803 illustrated in FIG. 8 may be unnecessary.

Here, since an additional delay may occur while the decorrelation units 801 generate a decorrelation signal, a delay value of the delay unit 803 may be different from a delay value applied in the encoder. FIG. 8 illustrates that the second decoding unit 304 outputs the N channel signals, wherein N is an odd number.

If the N channel signals output from the second encoding unit 304 are a PCM signal, the delay value of the delay unit 803 may be determined according to Equation 6.

Dec_Delay=Delay1(QMF Analysis)+Delay2(Hybrid QMF Analysis)+Delay3(QMF Synthesis)+Delay4(Decorrelator filtering delay) [Equation 6]

Here, Dec_Delay represents the delay value of the delay unit 803. Delay1 is a delay value generated by QMF analysis, Delay2 is a delay value generated by hybrid QMF analysis, and Delay3 is a delay value generated by QMF synthesis. Delay4 is a delay value generated when the decorrelation units 801 apply a decorrelation filter.

If the N channel signals output from the second encoding unit 304 are a QMF signal, the delay value of the delay unit 803 may be determined according to Equation 7.

Dec_Delay=Delay3(QMF Synthesis)+Delay4(Decorrelator filtering delay) [Equation 7]

First, each of the decorrelation units 801 may generate a decorrelation signal from the M channel signals input to the second decoding unit 304. The decorrelation signal generated by each of the decorrelation units 801 may be input to the upmixing units 802.

Here, unlike the MPS generating a decorrelation signal, the plurality of decorrelation units 801 may generate a decorrelation signal using the M channel signals. That is, when the M channel signals transmitted from the encoder are used to generate the decorrelation signal, sound quality may not deteriorate when a sound field of multi-channel signals is reproduced.

Hereinafter, operations of the upmixing unit 802 included in the second encoding unit 304 will be described. The M channel signals input to the second decoding unit 304 may be defined as $m(n)=[m_0(n), m_1(n), \ldots, m_{M-1}(n)]^T$. M decorrelation signals generated using the M channel signals may be defined as $d(n)=[d_{m_0}(n), d_{m_1}(n), \ldots, d_{m_{M-1}}(n)]^T$. Further, N channel signals output through the second decoding unit 304 may be defined as $y(n)=[y_0(n), y_1(n), \ldots, y_{M-1}(n)]^T$.

The second decoding unit 304 may output the N channel signals according to Equation 8.

$$y(n)=M(n)\times[m(n)\square d(n)] \qquad \text{[Equation 8]}$$

Here, M(n) is a matrix for upmixing the M channel signals at n sample times. Here, M(n) may be defined as Equation 9.

$$\begin{bmatrix} R_0(n) & 0 & \dots & & 0 \\ 0 & \ddots & & & \\ \vdots & & R_i(n) & & \vdots \\ & & & \ddots & 0 \\ 0 & & \dots & 0 & R_{M-1}(n) \end{bmatrix} \quad \text{[Equation 9]}$$

In Equation 9, 0 is a 2×2 zero matrix, and $R_i(n)$ is a 2×2 matrix, which may be defined as Equation 10.

$$R_i(n) = \begin{bmatrix} H^i_{LL}(n) & H^i_{LR}(n) \\ H^i_{RL}(n) & H^i_{RR}(n) \end{bmatrix} = \begin{bmatrix} H^i_{LL}(b) & H^i_{LR}(b) \\ H^i_{RL}(b) & H^i_{RR}(b) \end{bmatrix} + (1-\delta(n)) \begin{bmatrix} H^i_{LL}(b-1) & H^i_{LR}(b-1) \\ H^i_{RL}(b-1) & H^i_{RR}(b-1) \end{bmatrix} \quad \text{[Equation 10]}$$

Here, a component of $R_i(n)$, $\{H_{LL}^i(b), H_{LR}^i(b), H_{RL}^i(b), H_{RR}^i(b)\}$, may be derived from the spatial cue transmitted from the encoder. The spatial cue actually transmitted from the encoder may be determined by b index as a frame unit, and $R_i(n)$, applied by sample, may be determined by interpolation between neighboring frames.

$\{H_{LL}^i(b), H_{LR}^i(b), H_{RL}^i(b), H_{RR}^i(b)\}$ may be determined by Equation 11 according to an MPS method.

$$\begin{bmatrix} H^i_{LL}(b) & H^i_{LR}(b) \\ H^i_{RL}(b) & H^i_{RR}(b) \end{bmatrix} = \begin{bmatrix} c_L(b)\cdot\cos(\alpha(b)+\beta(b)) & c_L(b)\cdot\sin(\alpha(b)+\beta(b)) \\ c_R(b)\cdot\cos(\beta(b)-\alpha(b)) & c_L(b)\cdot\sin(\beta(b)-\alpha(b)) \end{bmatrix} \quad \text{[Equation 11]}$$

In Equation 11, $c_{L,R}$ may be derived from CLD. $\alpha(b)$ and $\beta(b)$ may be derived from CLD and ICC. Equation 11 may be derived according to a processing method of a spatial cue defined in MPS.

In Equation 8, operator □ is for generating a new vector row by interlacing components of vectors. In Equation 8, [m(n) □ d(n)] may be determined according to Equation 12.

$$v(n)=[m(n)\square d(n)]=[m_0(n),d_{m_0}(n),m_1(n),d_{m_1}(n),\dots,m_{M-1}(n),d_{m_{M-1}}(n)]^T \quad \text{[Equation 12]}$$

According to the foregoing process, Equation 9 may be represented as Equation 13.

signals, thereby minimizing distortion of sound quality in the upmixing process and generating a sound field effect maximally close to the original signals.

Equation 13 described above may also be expressed as Equation 14.

$$\begin{bmatrix} \begin{Bmatrix} y_{2i-2}(n) \\ y_{2i-1}(n) \end{Bmatrix} \end{bmatrix} = \begin{bmatrix} H^i_{LL}(n) & H^i_{LR}(n) \\ H^i_{RL}(n) & H^i_{RR}(n) \end{bmatrix} \begin{bmatrix} \begin{Bmatrix} m_i(n) \\ d_{m_i}(n) \end{Bmatrix} \end{bmatrix} \quad \text{[Equation 14]}$$

Figure 9:
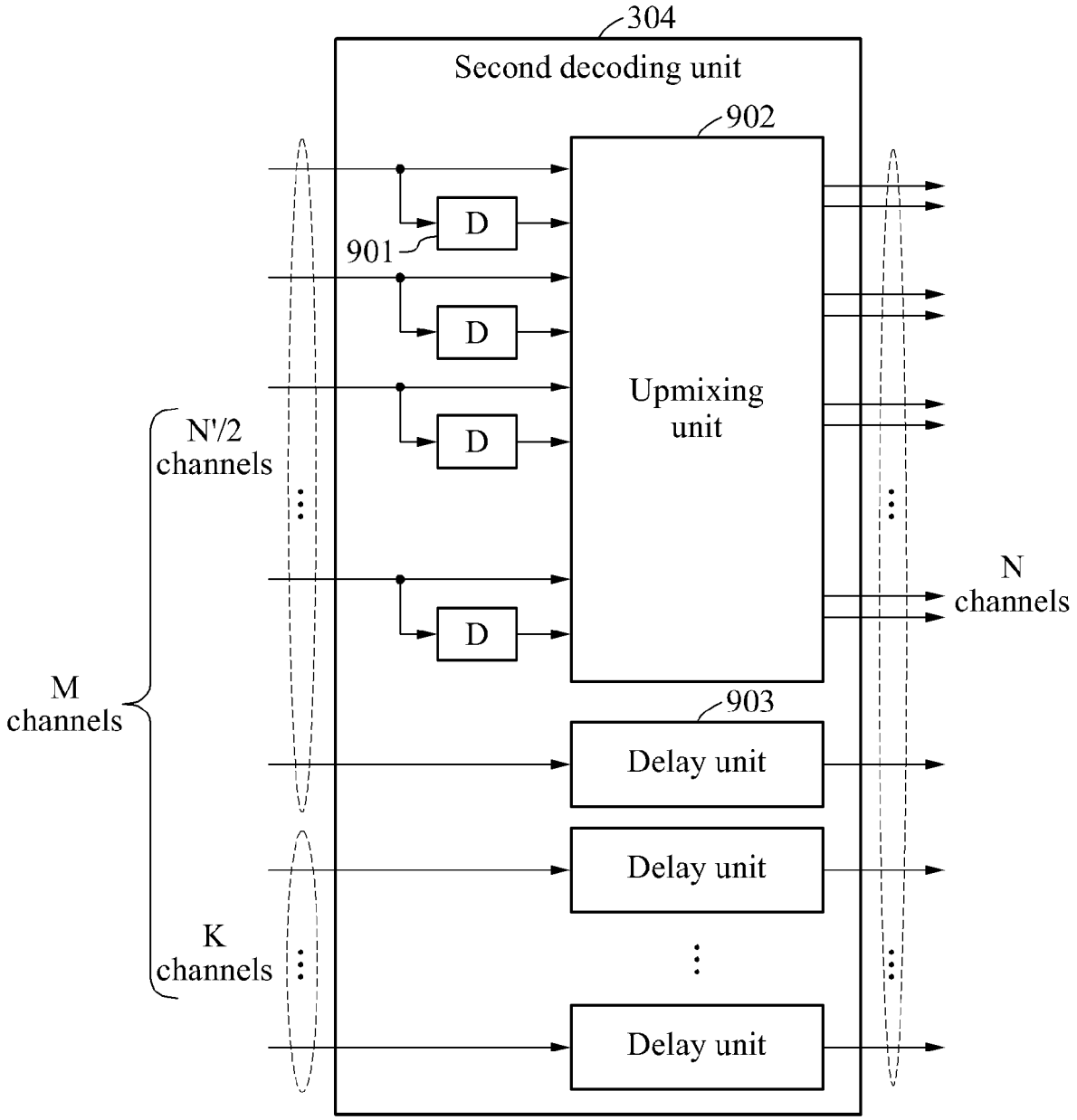
FIG. 9 is a second diagram illustrating a configuration of the second encoding unit of FIG. 3 in detail according to an embodiment.

FIG. 9 is a second diagram illustrating a configuration of the second encoding unit of FIG. 3 in detail according to an embodiment.

Referring to FIG. 9, the second decoding unit 304 may decode M channel signals transmitted from the first decoding unit 303 to output N channel signals. When N channel signals input to the encoder include N' channel signals and K channel signals, the second decoding unit 304 may also conduct processing in view of a processing result by the encoder.

For instance, assuming that the M channel signals input to the second decoding unit 304 satisfy Equation 5, the second decoding unit 304 may include a plurality of delay units 903 as in FIG. 9.

Here, when N' is an odd number with respect to the M channel signals satisfying Equation 5, the second decoding unit 304 may have the configuration shown in FIG. 9. When N' is an even number with respect to the M channel signals satisfying Equation 5, one delay unit 903 disposed below an upmixing unit 902 may be excluded from the second decoding unit 304 in FIG. 9.

Figure 10:
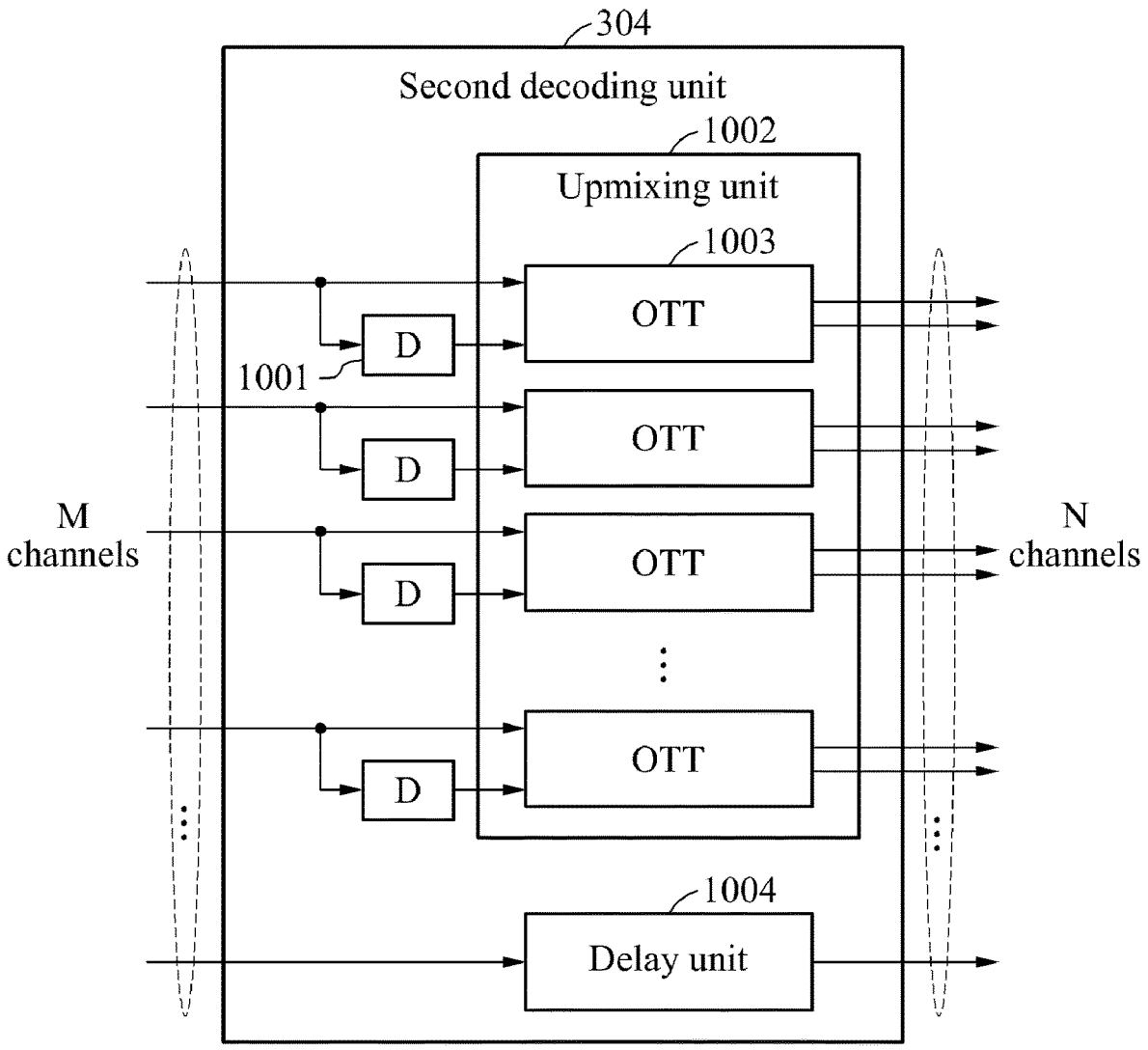
FIG. 10 is a third diagram illustrating a configuration of the second encoding unit of FIG. 3 in detail according to an embodiment.

FIG. 10 is a third diagram illustrating a configuration of the second encoding unit of FIG. 3 in detail according to an embodiment.

Referring to FIG. 10, the second decoding unit 304 may decode M channel signals transmitted from the first decoding unit 303 to output N channel signals. Here, as shown in FIG. 10, an upmixing unit 1002 of the decoding unit 304 may include a plurality of one-to-two (OTT) signal processing units 1003.

Here, each of the signal processing units 1003 may generate two channel signals using one of the M channel signals and a decorrelation signal generated by a decorrelation unit 1001. The signal processing units 1003 disposed in parallel in the upmixing unit 1002 may generate N−1 channel signals.

$$\begin{bmatrix} \begin{Bmatrix} y_0(n) \\ y_1(n) \end{Bmatrix} \\ \vdots \\ \begin{Bmatrix} y_{2i-1}(n) \\ y_{2i-1}(n) \end{Bmatrix} \\ \vdots \\ \begin{Bmatrix} y_{N-2}(n) \\ y_{N-1}(n) \end{Bmatrix} \end{bmatrix} = \begin{bmatrix} \begin{bmatrix} H^0_{LL}(n) & H^0_{LR}(n) \\ H^0_{RL}(n) & H^0_{RR}(n) \end{bmatrix} & 0 & \dots & & 0 \\ 0 & \ddots & & & \\ \vdots & & \begin{bmatrix} H^i_{LL}(n) & H^i_{LR}(n) \\ H^i_{RL}(n) & H^i_{RR}(n) \end{bmatrix} & & \vdots \\ & & & \ddots & 0 \\ 0 & & \dots & 0 & \begin{bmatrix} H^{M-1}_{LL}(n) & H^{M-1}_{LR}(n) \\ H^{M-1}_{RL}(n) & H^{M-1}_{RR}(n) \end{bmatrix} \end{bmatrix} \begin{bmatrix} \begin{Bmatrix} m_0(n) \\ d_{m_0}(n) \end{Bmatrix} \\ \begin{Bmatrix} m_1(n) \\ d_{m_1}(n) \end{Bmatrix} \\ \vdots \\ \begin{Bmatrix} m_{M-1}(n) \\ d_{m_{M-1}}(n) \end{Bmatrix} \end{bmatrix} \quad \text{[Equation 13]}$$

In Equation 13, { } is used to clarify processes of processing an input signal and an w output signal. By Equation 12, the M channel signals are paired with the decorrelation signals to be inputs of an upmixing matrix in Equation 13. That is, according to Equation 13, the decorrelation signals are applied to the respective M channel If N is an even number, a delay unit 1004 may be excluded from the second decoding unit 304. Accordingly, the signal processing units 1003 disposed in parallel in the upmixing unit 1002 may generate N channel signals.

The signal processing units 1003 may conduct upmixing according to Equation 14. Upmixing processes performed by all signal processing units 1003 may be represented as a single upmixing matrix as in Equation 13.

Figure 11:
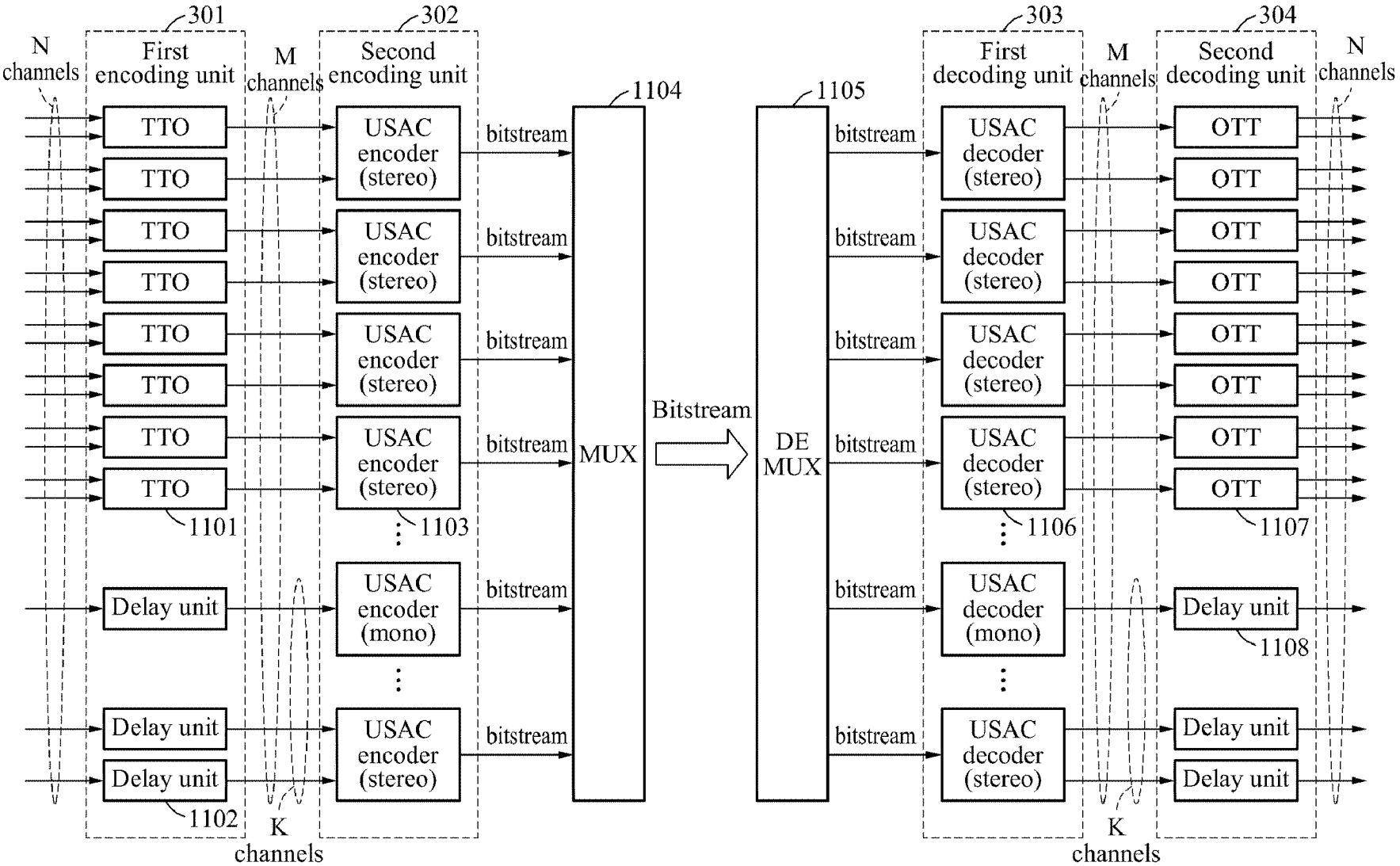
FIG. 11 illustrates an example of realizing FIG. 3 according to an embodiment.

FIG. 11 illustrates an example of realizing FIG. 3 according to an embodiment.

Referring to FIG. 11, the first encoding unit 301 may include a plurality of TTO downmixing units 1101 and a plurality of delay units 1102. The second encoding unit 302 may include a plurality of USAC encoders 1103. The first decoding unit 303 may include a plurality of USAC decoders 1106, and the second decoding unit 304 may include a plurality of OTT upmixing units 304 and a plurality of delay units 1108.

Referring to FIG. 11, the first encoding unit 301 may output M channel signals using N channel signals. Here, the M channel signals may be input to the second encoding unit 302. The M channel signals may be input to the second encoding unit 302. Here, among the M channel signals, pairs of channel signals passing through the TTO downmixing units 1101 may be encoded into stereo forms by the USAC encoders 1103 of the second encoding unit 302.

Among the M channel signals, channel signals passing through the delay units 1102, instead of the downmixing units 1101, may be encoded into mono or stereo forms by the USAC encoders 1103. That is, among the M channels, one channel signal passing through the delay units 1102 may be encoded into a mono form by the USAC encoders 1103. Among the M channel signals, two channel signals passing through two delay units 1102 may be encoded into stereo forms by the USAC encoders 1103.

The M channel signals may be encoded by the second encoding unit 302 and generated into a plurality of bitstreams. The bitstreams may be reformatted into a single bitstream through a multiplexer 1104.

The bitstream generated by the multiplexer 1104 is transmitted to a demultiplexer 1105, and the demultiplexer 1105 may demultiplex the bitstream into a plurality of bitstreams corresponding to the USAC decoders 303 included in the first decoding unit 303.

The plurality of demultiplexed bitstreams may be input to the respective USAC decoders 1106 in the first decoding unit 303. The USAC decoders 303 may decode the bitstreams according to the same encoding method as used by the USAC encoders 1103 in the second encoding unit 302. The first decoding unit 303 may output M channel signals from the plurality of bitstreams.

Subsequently, the second decoding unit 304 may output N channel signals using the M channel signals. Here, the second decoding unit 304 may upmix part of the M input channel signals using the OTT upmixing units 1107. In detail, one channel signal of the M channel signals is input to the upmixing units 1107, and the upmixing units 1107 may generate two channel signals using the one channel signal and a decorrelation signal. For instance, the upmixing units 1107 may generate the two channel signals using Equation 14.

Meanwhile, each of the upmixing units 1107 may perform upmixing M times using an upmixing matrix corresponding to Equation 14, and accordingly the second decoding unit 304 may generate M channel signals. Thus, as Equation 13 is derived by performing upmixing based on Equation 14 M times, M of Equation 13 may be the same as a number of upmixing units 1107 included in the second decoding unit 304.

Among the N channel signals, K channel signals processed by the delay units 1102, instead of the TTO downmixing units 11011, in the first encoding unit 301, may be processed by the delay units 1108 in the second decoding unit 304, not by the OTT upmixing units 1107.

Figure 12:
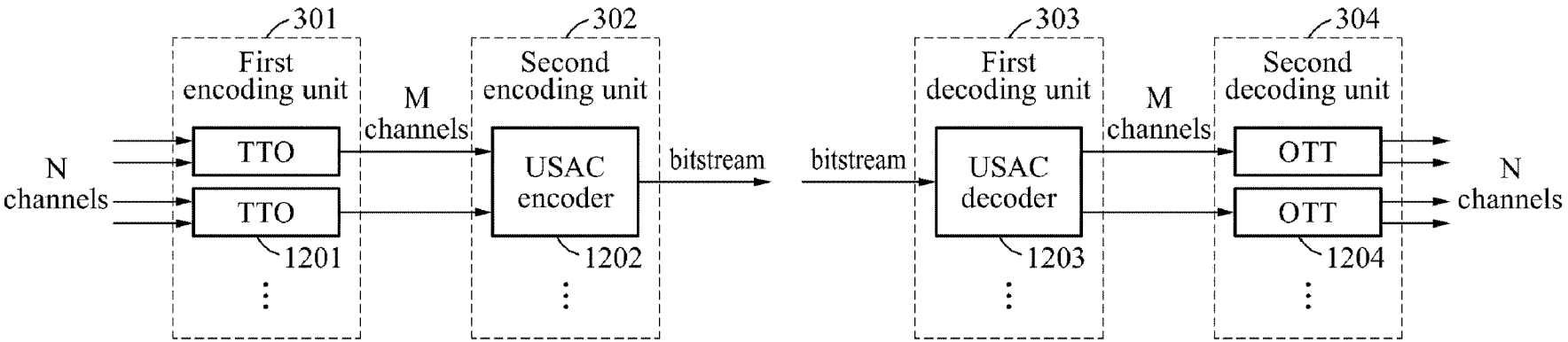
FIG. 12 simplifies FIG. 11 according to an embodiment.

FIG. 12 simplifies FIG. 11 according to an embodiment.

Referring to FIG. 12, N channel signals may be input in pairs to downmixing units 1201 included in the first encoding unit 301. The downmixing units 1201 have the TTO structure and may downmix two channel signals to output one channel signal. The first encoding unit 301 may output M channel signals from the N channel signals using a plurality of downmixing units 1201 disposed in parallel.

A USAC encoder 1202 in a stereo type included in the second encoding unit 302 may encode two channel signals output from the two downmixing units 1201 to generate a bitstream.

A USAC decoder 1203 in a stereo type included in the first decoding unit 303 may output two channel signals forming M channel signals from the bitstream. The two output channel signals may be input to two upmixing units 1204 having the OTT structure included in the second decoding unit 304, respectively. The upmixing units 1204 may output two channel signals forming N channel signals using one channel signal and a decorrelation signal.

Figure 13:
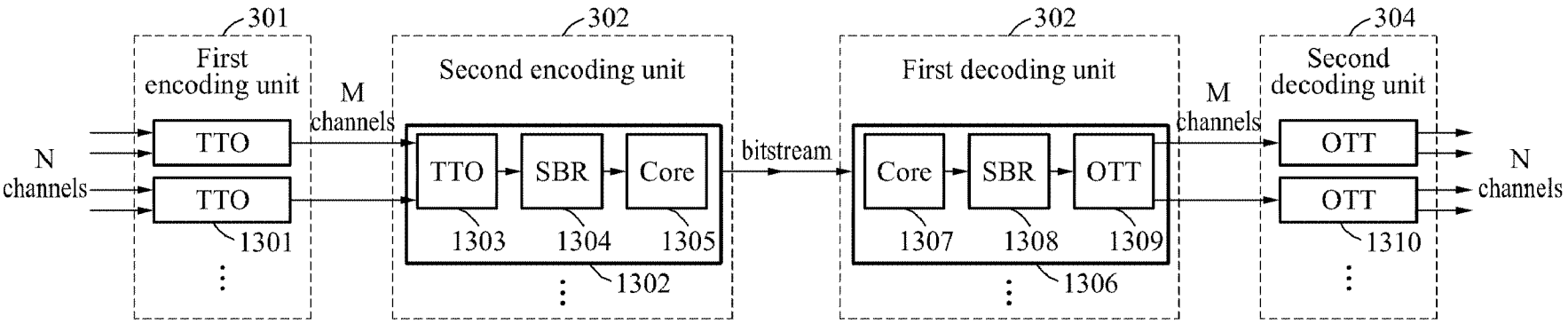
FIG. 13 illustrates a configuration of the second encoding unit and the first decoding unit of FIG. 12 in detail according to an embodiment.

FIG. 13 illustrates a configuration of the second encoding unit and the first decoding unit of FIG. 12 in detail according to an embodiment.

In FIG. 13, a USAC encoder 1302 included in the second encoding unit 302 may include a downmixing unit 1303 with the TTO structure, a spectral band replication (SBR) unit 1304 and a core encoding unit 1305.

A downmixing unit 1301 with the ITO structure included in the first encoding unit 301 may downmix two channel signals among N channel signals to output one channel signal forming M channel signals.

Two channel signals output from two downmixing units 1301 in the first encoding unit 301 may be input to the TTO downmixing unit 1303 in the USAC encoder 1302. The downmixing unit 1303 may downmix the input two channel signals to generate one channel signal, which is a mono signal.

The SBR unit 1304 may extract only a low-frequency band, except for a high-frequency band, from the mono signal for parameter encoding for the high-frequency band of the mono signal generated by the downmixing unit 1301. The core encoding unit 1305 may encode the low-frequency band of the mono signal corresponding to a core band to generate a bitstream.

To sum up, according to the embodiment, a TTO downmixing process may be consecutively performed so as to generate a bitstream from the N channel signals. That is, the TTO downmixing unit 1301 may downmix two stereo channel signals among the N channel signals. Channel signals output respectively from two downmixing units 1301 may be input as part of the M channel signals to the TTO downmixing unit 1303. That is, among the N channel signals, four channel signals may be output as a single channel signal through consecutive TTO downmixing.

The bitstream generated in the second encoding unit 302 may be input to a USAC decoder 1306 of the first decoding unit 302. In FIG. 13, the USAC decoder 1306 included in the second encoding unit 302 may include a core decoding unit 1307, an SBR, unit 1308, and an OTT upmixing unit 1309.

The core decoding unit 1307 may output the mono signal of the core band corresponding to the low-frequency band using the bitstream. The SBR unit 1308 may copy the low-frequency band of the mono signal to reconstruct the high-frequency band. The upmixing unit 1309 may upmix the mono signal output from the SBR unit 1308 to generate a stereo signal forming M channel signals.

OTT upmixing units 1310 included in the second decoding unit 304 may upmix the mono signal included in the stereo signal generated by the first decoding unit 302 to generate a stereo signal.

To sum up, according to the embodiment, an OTT upmixing process may be consecutively performed in order to generate N channel signals from the bitstream. That is, the OTT upmixing unit 1309 may upmix the mono signal to generate a stereo signal. Two mono signals forming the stereo signal output from the upmixing unit 1309 may be input to the OTT upmixing units 1310. The OTT upmixing units 1310 may upmix the input mono signals to output a stereo signal. That is, the mono signal is subjected to consecutive OTT upmixing to generate four channel signals.

Figure 14:
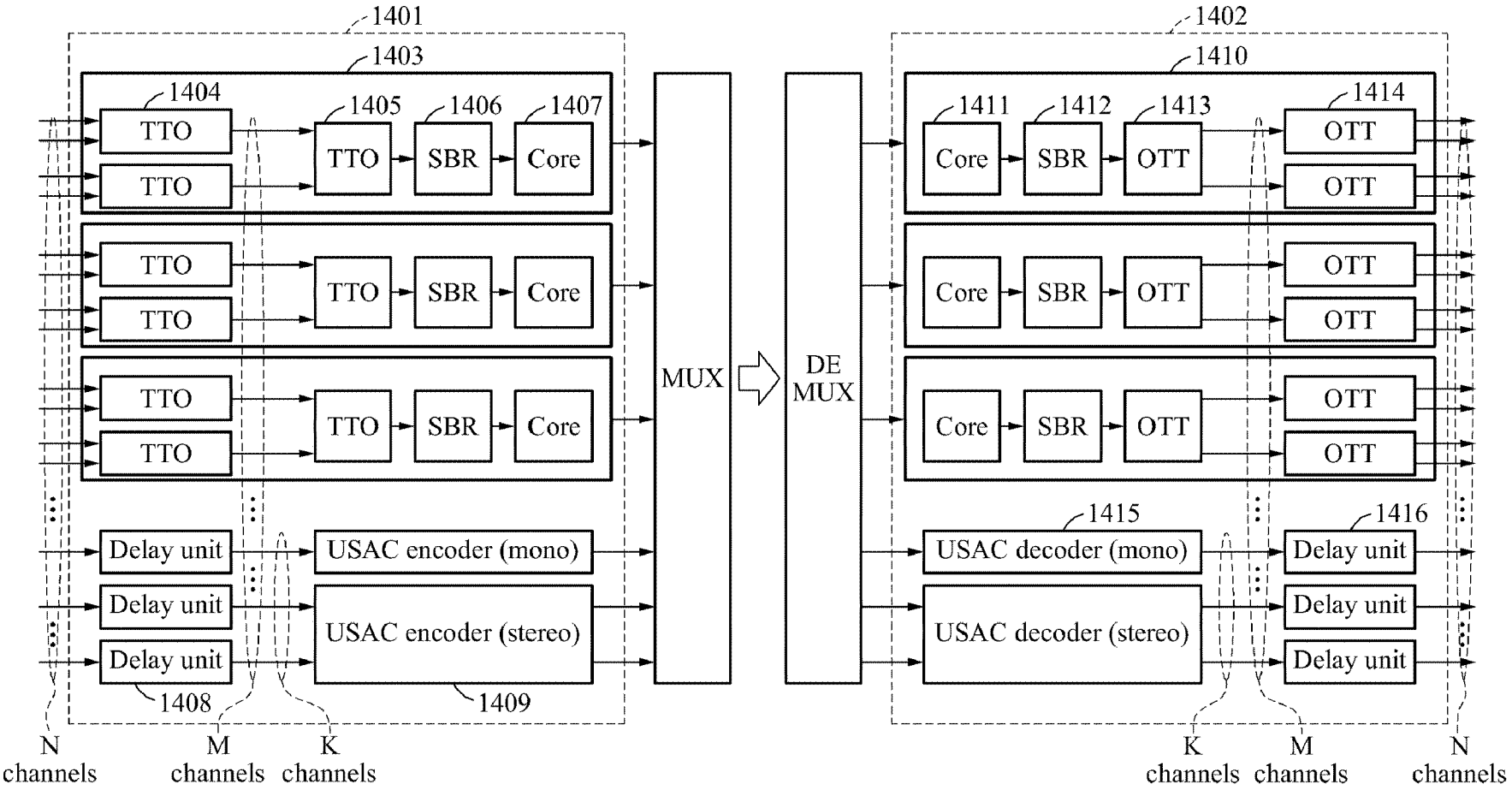
FIG. 14 illustrates a result of combining the first encoding unit and the second encoding unit of FIG. 11 and combining the first decoding unit and the second decoding unit of FIG. 11 according to an embodiment.

FIG. 14 illustrates a result of combining the first encoding unit and the second encoding unit of FIG. 11 and combining the first decoding unit and the second decoding unit of FIG. 11 according to an embodiment.

The first encoding unit and the second encoding unit of FIG. 11 may be combined into a single encoding unit 1401 shown in FIG. 14. Also, the first decoding unit and the second decoding unit of FIG. 11 may be combined into a single decoding unit 1402 shown in FIG. 14.

The encoding unit 1401 of FIG. 14 may include an encoding unit 1403 which includes a USAC encoder including a ITO downmixing unit 1405, an SBR unit 1406 and a core encoding unit 1407 and further includes TTO downmixing units 1404. Here, the encoding unit 1401 may include a plurality of encoding units 1403 disposed in parallel. Alternatively, the encoding unit 1403 may correspond to the USAC encoder including the TTO downmixing units 1404.

That is, according to the present embodiment, the encoding unit 1403 may consecutively apply TTO downmixing to four channel signals among N channel signals, thereby generating a mono signal.

In the same manner, the decoding unit 1402 of FIG. 14 may include a decoding unit 1410 which includes a USAC decoder including a core decoding unit 1411, an SBR unit 1412 and an OTT upmixing unit 1413 and further includes OTT upmixing units 1414. Here, the decoding unit 1402 may include a plurality of decoding units 1410 disposed in parallel. Alternatively, the decoding unit 1410 may correspond to the USAC decoder including the OTT upmixing units 1414.

That is, according to the present embodiment, the decoding unit 1410 may to consecutively apply OTT upmixing to a mono signal, thereby generating four channel signals among N channel signals.

Figure 15:
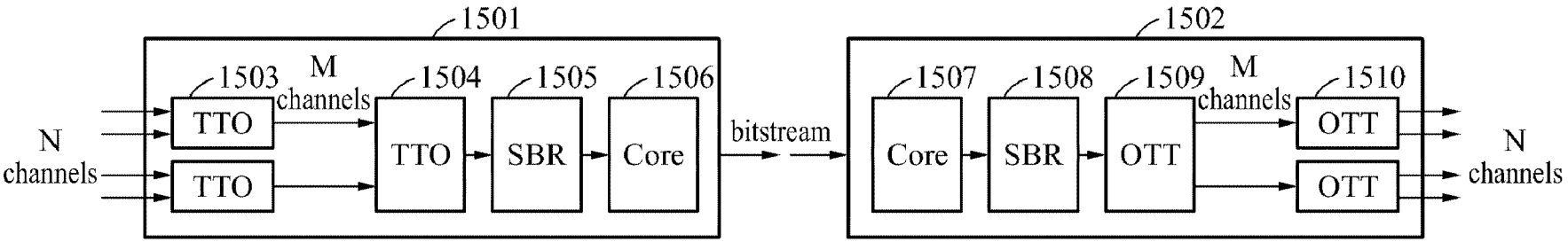
FIG. 15 simplifies FIG. 14 according to an embodiment.

FIG. 15 simplifies FIG. 14 according to an embodiment.

An encoding unit 1501 of FIG. 15 may correspond to the encoding unit 1403 of FIG. 14. Here, the encoding unit 1501 may correspond to a modified USAC encoder. That is, the modified USAC encoder may be configured by adding TTO downmixing units 1503 to an original USAC encoder including a TTO downmixing unit 1504, an SBR unit 1505 and a core encoding unit 1506.

A decoding unit 1502 of FIG. 15 may correspond to the decoding unit 1410 of FIG. 14. Here, the decoding unit 1502 may correspond to a modified USAC decoder. That is, the modified USAC decoder may be configured by adding OTT upmixing units 1510 to an original USAC decoder including a core decoding unit 1507, an SBR unit 1508 and an OTT upmixing unit 1509.

Figure 16:
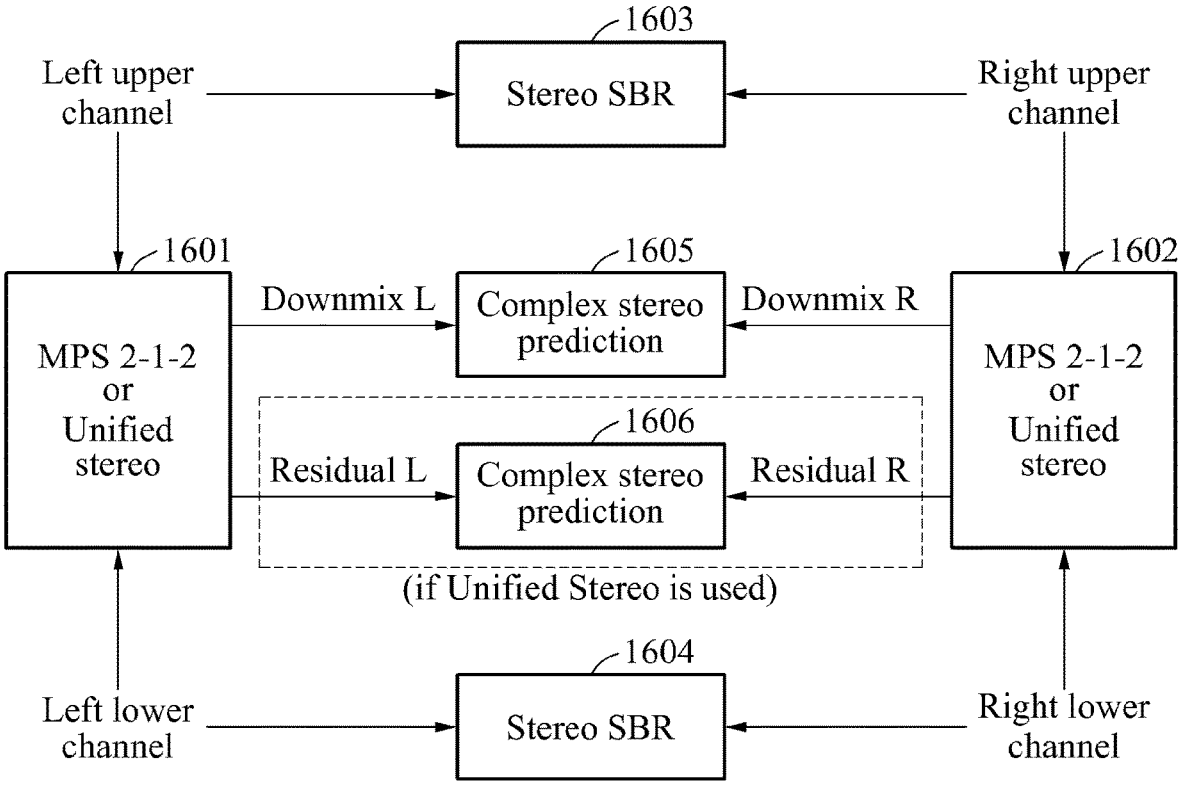
FIG. 16 illustrates that the USAC 3D encoder of the 3D audio encoder of FIG. 1 operates in Quadruple Channel Element (QCE) mode according to an embodiment.

FIG. 16 illustrates that the USAC 3D encoder of the 3D audio encoder of FIG. 1 operates in Quadruple Channel Element (QCE) mode according to an embodiment.

The QCE mode may refer to an operation mode enabling the USAC 3D encoder to generate two channel prediction elements (CPEs) using four channel signals. The USAC 3D encoder may determine through a flag, qceIndex, whether to operate in QCE mode.

Referring to FIG. 16, an MPS 2-1-2 unit 1601 as MPEG Surround based on a stereo tool may combine a left upper channel and a left lower channel which form a vertical channel pair. In detail, the MPS 2-1-2 unit 1601 may downmix the left upper channel and the left lower channel to generate Downmix L. If a unified stereo unit 1601 is used instead of the MPS 2-1-2 unit 1601, the unified stereo unit 1601 may downmix the left upper channel and the left lower channel to generate Downmix L and Residual L.

Likewise, an MPS 2-1-2 unit 1602 may combine a right upper channel and a right lower channel which form a vertical channel pair. In detail, the MPS 2-1-2 unit 1602 may downmix the right upper channel and the right lower channel to generate Downmix R. If a unified stereo unit 1602 is used instead of the MPS 2-1-2 unit 1602, the unified stereo unit 1602 may downmix the right upper channel and the right lower channel to generate Downmix R and Residual R.

A joint stereo encoding unit 1605 may combine Downmix L and Downmix R using probability of complex stereo prediction. In the same manner, a joint stereo encoding unit 1606 may combine Residual L and Residual R using the probability of complex stereo prediction.

A stereo SBR unit 1603 may apply an SBR to the left upper channel and the right upper channel which form a horizontal channel pair. Likewise, a stereo SBR unit 1604 may apply an SBR to the left lower channel and the right lower channel which form a horizontal channel pair.

The USAC 3D encoder of FIG. 16 may encode the four channel signals, the left upper channel, the right upper channel, the left lower channel and the right lower channel, in QCE mode. In detail, the USAC 3D of FIG. 16 may encode the channel signals in QCE mode by swapping a second channel of a first element and a first channel of a second element before or after the stereo SBR unit 1603 or the stereo SBR unit 1605 is applied.

Alternatively, the USAC 3D encoder of FIG. 16 may encode the channel signals in QCE mode by swapping the second channel of the first element and the first channel of the second element before or after the MPS 2-1-2 unit 1601 and the joint stereo encoding unit 1605 are applied or before or after the MPS 2-1-2 unit 1602 and the joint stereo encoding unit 1605 are applied.

Figure 17:
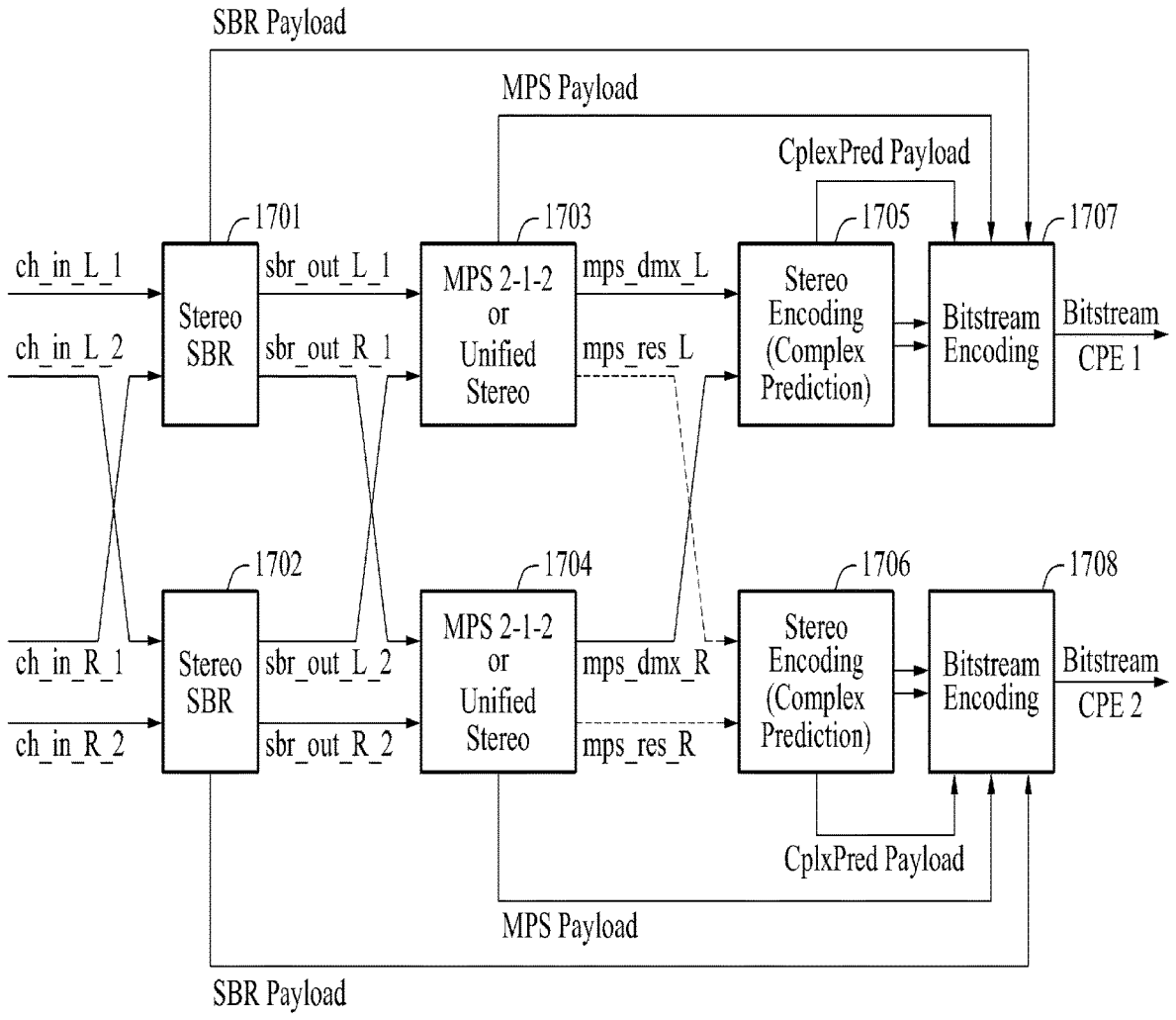
FIG. 17 illustrates that the USAC 3D encoder of the 3D audio encoder of FIG. 1 operates in QCE mode using two CPEs according to an embodiment.

FIG. 17 illustrates that the USAC 3D encoder of the 3D audio encoder of FIG. 1 operates in QCE mode using two CPEs according to an embodiment.

FIG. 17 schematizes FIG. 16. Suppose that channel signals Ch_in_L_1, Ch_in_L_2, Ch_in_R_1 and Ch_in_R_2 are input to the USAC 3D encoder. Referring to FIG. 17, channel signal Ch_in_L_2 may be input to a stereo SBR unit 1702 via swapping, and channel signal Ch_in_R_1 may be input to a stereo SBR unit 1701 via swapping.

The stereo SBR unit 1701 may output sbr_out_L_1 and sbr_out_R_1, and the stereo SBR unit 1702 may output sbr_out_L_2 and sbr_out_R_2. Meanwhile, the stereo SBR unit 1701 may transmit an SBR payload to a bitstream encoding unit 1707, and the stereo SBR unit 1702 may transmit an SBR payload to a bitstream encoding unit 1708.

sbr_out_L_2, output from the stereo SBR unit 1702, may be input to an MPS 2-1-2 unit 1703 via swapping. Also, sbr_out_L_1, output from the stereo SBR unit 1701, may be input to the MPS 2-1-2 unit 1703. Meanwhile, sbr_out_R_1, output from the stereo SBR unit 1701, may be input to an MPS 2-1-2 unit 1704 via swapping. Also, sbr_out_R_2, output from the stereo SBR unit 1702, may be input to the MPS 2-1-2 unit 1704. The MPS 2-1-2 unit 1703 may transmit an MPS payload to the bitstream encoding unit 1707, and the MPS 2-1-2 unit 1704 may transmit an MPS payload to the bitstream encoding unit 1708. In FIG. 17, the MPS 2-1-2 unit 1703 may be replaced with a unified stereo unit 1703, and the MPS 2-1-2 unit 1704 may be replaced with a unified stereo unit 1704.

mps_dmx_L output from the MPS 2-1-2 unit 1703 may be input to a joint stereo encoding unit 1705. Meanwhile, if the MPS 2-1-2 unit 1703 is replaced with the unified stereo unit 1703, mps_dmx_L output from the unified stereo unit 1703 may be input to the joint stereo encoding unit 1705 and mps_res_L may be input to a joint stereo encoding unit 1706 via swapping.

Further, mps_dmx_R output from the MPS 2-1-2 unit 1704 may be input to the joint stereo encoding unit 1705 via swapping. Meanwhile, when the MPS 2-1-2 unit 1703 is replaced with the unified stereo unit 1703, mps_dmx_R output from the unified stereo unit 1703 may be input to the joint stereo encoding unit 1705 via swapping and mps_res_R may be input to the joint stereo encoding unit 1706. The joint stereo encoding unit 1705 may transmit a CplxPred payload to the bitstream encoding unit 1707, and the joint stereo encoding unit 1706 may transmit the CplxPred payload to the bitstream encoding unit 1708.

The MPS 2-1-2 unit 1703 and the MPS 2-1-2 unit 1704 may downmix a stereo signal through the TTO structure to output a mono signal.

The bitstream encoding unit 707 may encode the stereo signal output from the joint stereo encoding unit 1705 to generate a bitstream corresponding to CPE1. Likewise, the bitstream encoding unit 1708 may encode the stereo signal output from the joint stereo encoding unit 1706 to generate a bitstream corresponding to CPE2.

Figure 18:
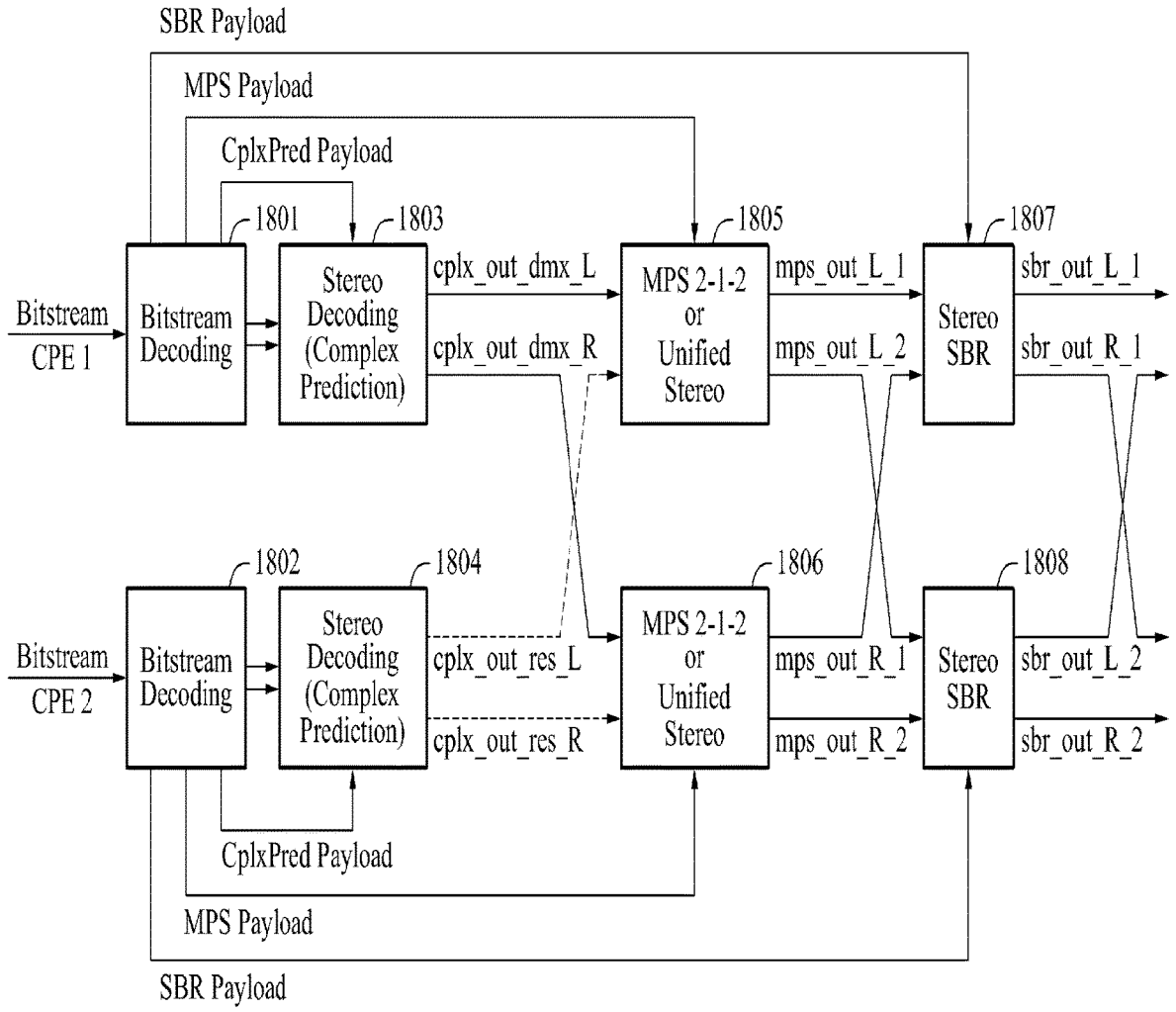
FIG. 18 illustrates that the USAC 3D decoder of the 3D audio decoder of FIG. 1 operates in QCE mode using two channel prediction elements (CPEs) according to an embodiment.

FIG. 18 illustrates that the USAC 3D decoder of the 3D audio decoder of FIG. 1 operates in QCE mode using two CPEs according to an embodiment, Channel signals illustrated in FIG. 18 may be defined by Table 1.

TABLE 1

| | |
|---|---|
| cplx_out_dmx_L[ ] | First channel of first CPE after complex prediction stereo decoding. |
| cplx_out_dmx_R[ ] | Second channel of first CPE after complex prediction stereo decoding. |
| cplx_out_res_R[ ] | Second channel of second CPE after complex prediction stereo decoding. (zero if qceIndex = 1) |
| mps_out_L_1[ ] | First output channel of first MPS box. |
| mps_out_L_2 [ ] | Second output channel of first MPS box. |
| mps_out_R_1[ ] | First output channel of second MPS box. |
| mps_out_R_2[ ] | Second output channel of second MPS box. |
| sbr_out_L_1[ ] | First output channel of first Stereo SBR box. |
| sbr_out_R_1[ ] | Second output channel of first Stereo SBR box. |
| sbr_out_L_2[ ] | First output channel of second Stereo SBR box. |
| sbr_out_R_2[ ] | Second output channel of second Stereo SBR box. |

Suppose that the bitstream corresponding to CPE1 generated in FIG. 17 is input to a bitstream decoding unit 1801 and the bitstream corresponding to CPE2 is input to a bitstream decoding unit 1802.

The QCE mode may refer to an operation mode enabling the USAC 3D decoder to generate four channel signals using two consecutive CPEs. In detail, the QCE mode enables the USAC 3D decoder to efficiently perform joint coding of four channel signals horizontally or vertically distributed.

For instance, a QCE includes two consecutive CPEs and may be generated by combining joint stereo coding with complex stereo prediction in horizontal direction and MPEG Surround-based stereo tools in vertical direction. Further, the QCE may be generated by swapping channel signals between tools included in the USAC 3D decoder.

The USAC 3D decoder may determine whether to operate in QCE mode through a flag. qceIndex, included in UsacChannelPairElementConfig( ).

The USAC 3D decoder may operate in different manners based on qceIndex illustrated in Table 2.

TABLE 2

| qceIndex | meaning |
|---|---|
| 0 | Stereo CPE |
| 1 | QCE without residual |
| 2 | QCE with residual |
| 3 | -reserved- |

The bitstream decoding unit 1801 may transmit a CplxPred payload included in the bitstream to a joint stereo decoding unit 1803, transmit an SBR payload to an MPS 2-1-2 unit 1805, and transmit an SBR payload to a stereo SBR unit 1807. The bitstream decoding unit 1801 may extract a stereo signal from the bitstream and transmit the stereo signal to the joint stereo decoding unit 1803.

Likewise, the bitstream decoding unit 1802 may transmit a CplxPred payload included in the bitstream to a joint stereo decoding unit 1804, transmit an SBR payload to an MPS 2-1-2 unit 1806, and transmit an SBR payload to a stereo SBR unit 1808. The bitstream decoding unit 1802 may extract a stereo signal from the bitstream.

The joint stereo decoding unit 1803 may generate cplx_out_dmx_L and cplx_out_dmx_R using the stereo signal. The joint stereo decoding unit 1804 may generate cplx_out_res_L and cplx_out_res_R using the stereo signal.

The joint stereo decoding unit 1803 and the joint stereo decoding unit 1804 may conduct decoding according to joint stereo in an MDCT domain using probability of complex stereo prediction. Complex stereo prediction is a tool for efficiently coding a pair of two channel signals different in level or phase. A left channel and a right channel may be reconstructed based on a matrix illustrated in Equation 15.

$$\begin{bmatrix} l \\ r \end{bmatrix} = \begin{bmatrix} 1-\alpha_{Re} & -\alpha_{Im} & 1 \\ 1+\alpha_{Re} & \alpha_{Im} & -1 \end{bmatrix} \begin{bmatrix} dmx_{Re} \\ dmx_{Im} \\ res \end{bmatrix} \quad \text{[Equation 15]}$$

Here, $\alpha$ is a complex-valued parameter, and $dmx_{Im}$ is MDST corresponding to MDCT of $dmx_{Re}$ as a downmixed channel signal. res is a residual signal derived through complex stereo prediction.

cplx_out_dmx_L generated from the joint stereo decoding unit 1803 may be input to the MPS 2-1-2 unit 1805. cplx_out_dmx_R generated from the joint stereo decoding unit 1803 may be input to the MPS 2-1-2 unit 1806 via swapping.

The MPS 2-1-2 unit 1805 and the MPS 2-1-2 unit 1806, which relate to stereo-based MPEG Surround, may generate a stereo signal in a QMF domain using a mono signal and a decorrelation signal, without using a residual signal. A unified stereo unit 1805 and a unified stereo unit 1806 may output a stereo signal in the QMF domain using a mono signal and a residual signal in the stereo-based MPEG Surround.

The MPS 2-1-2 unit 1805 and the MPS 2-1-2 unit 1806 may upmix mono signals through the OTT structure to output a stereo signal formed of two channel signals.

If the MPS unit 1805 is replaced with the unified stereo unit 1805, cplx_out_dmx_L generated from the joint stereo decoding unit 1803 may be input to the unified stereo unit 1805 and cplx_out_res_L generated from the joint stereo decoding unit 1804 may be input to the unified stereo unit 1805 via swapping.

Likewise, if the MPS 2-1-2 unit 1806 is replaced with the unified stereo unit 1806, cplx_out_dmx_R generated from the joint stereo decoding unit 1803 may be input to the unified stereo unit 1806 via swapping and cplx_out_res_R generated from the joint stereo decoding unit 1804 may be input to the unified stereo unit 1806. The joint stereo decoding unit 1803 and the joint stereo decoding unit 1804 may output a downmixed signal of a core band corresponding to a low-frequency band through core decoding.

That is, cplx_out_dmx_R corresponding to a second channel of a first element and cplx_out_res_L corresponding to a first channel of a second element may be swapped before decoding according to an MPEG Surround method.

mps_out_L_1 output from the MPS 2-1-2 unit 1805 or the unified stereo unit 1805 may be input to the stereo SBR unit 1807, and mps_out_R_1 output from the MPS 2-1-2 unit 1806 or the unified stereo unit 1806 may be input to the stereo SBR unit 1807 via swapping. Likewise, mps_out_L_2 output from the MPS 2-1-2 unit 1805 or the unified stereo unit 1805 may be input to the stereo SBR unit 1808 via swapping, and mps_out_R_2 output from the MPS 2-1-2 unit 1806 or the unified stereo unit 1806 may be input to the stereo SBR unit 1808.

Subsequently, the stereo SBR unit 1807 may output sbr_out_L_1 and sbr_out_R_1 using mps_out_L_1 and mps_out_R_1. The stereo SBR unit 1808 may output sbr_out_L_2 and sbr_out_R_2 using mps_out_L_2 and mps_out_R_2. Here, sbr_out_R_1 and mps_out_L_2 may be input to different components via swapping.

Figure 19:
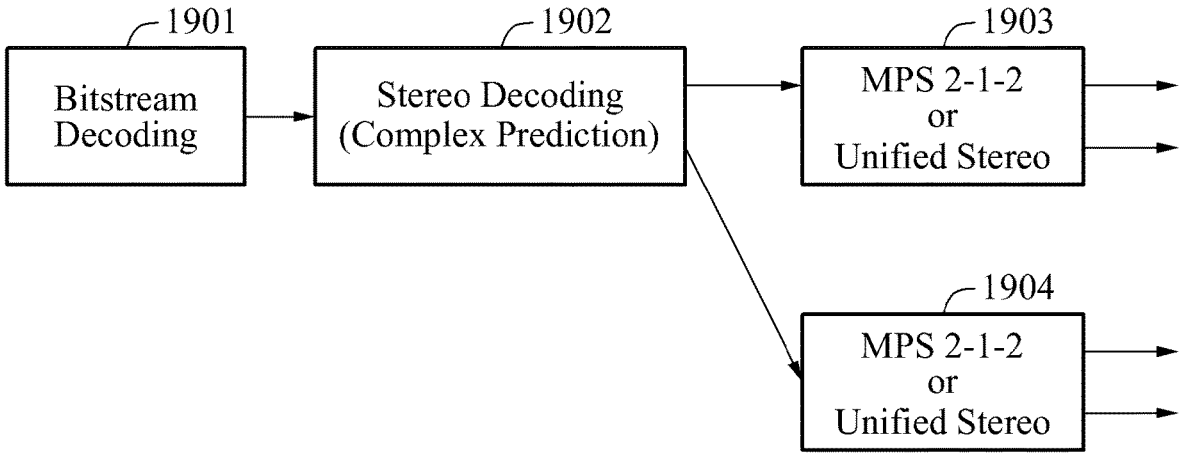
FIG. 19 simplifies FIG. 18 according to an embodiment.

FIG. 19 simplifies FIG. 18 according to an embodiment.

When the stereo decoding unit 1804 does not generate cplx_out_res_L and cplx_out_res_R and the stereo SBR unit 1807 and the stereo SBR unit 1808 are not used in FIG. 18, FIG. 18 may be simplified into FIG. 19. Here, a case that the stereo decoding unit 1804 does not generate cplx_out_res_L and cplx_out_res_R means that the MPS 2-1-2 unit 1703 and the MPS 2-1-2 unit 1704 are used in the USAC 3D encoder of FIG. 17, instead of the unified stereo unit 1703 and the unified stereo unit 1704. In FIG. 18, the stereo SBR unit 1807 and the stereo SBR unit 1808 may be enabled or disabled based on a decoding mode.

A bitstream decoding unit 1901 may generate a stereo signal from a bitstream. A joint stereo decoding unit 1902 may output cplx_out_dmx_L and cplx_out_dmx_R using the stereo signal. cplx_out_dmx_L may be input to an MPS 2-1-2 unit 1903, and cplx_put_dmx_R may be input to an MPS 2-1-2 unit 1904 via swapping. The MPS 2-1-2 unit 1903 may upmix cplx_out_dmx_L to generate stereo signals, mps_out_L_1 and mps_out_L_2. Meanwhile, the MPS 2-1-2 unit 1903 may upmix cplx_out_dmx_R to generate stereo signals, mps_out_R_1 and mps_out_R_2.

Figure 20:
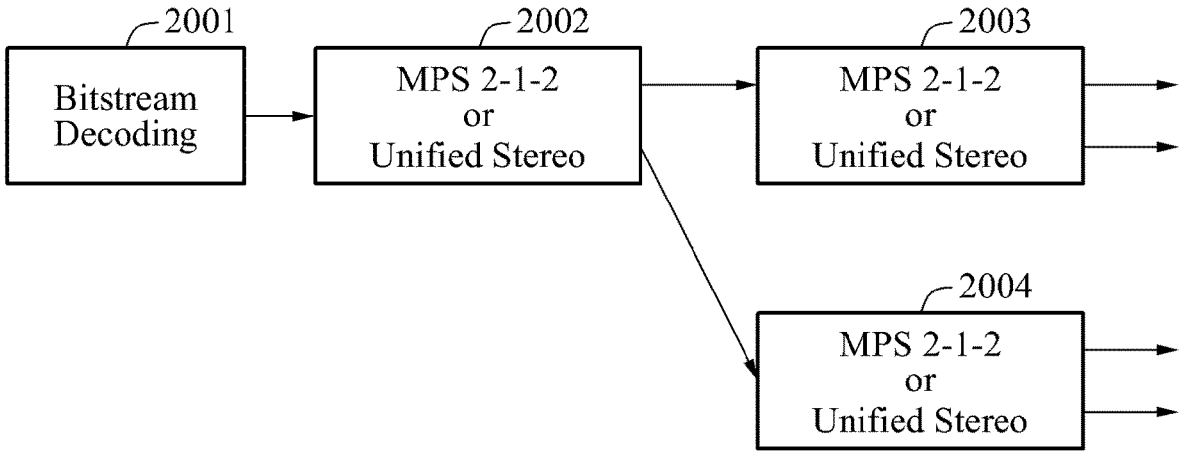
FIG. 20 illustrates a modified configuration of FIG. 19 according to an embodiment.

FIG. 20 illustrates a modified configuration of FIG. 19 according to an embodiment.

Unlike FIG. 19, FIG. 20 illustrates that the joint stereo decoding unit 1902 is replaced with an MPS 2-1-2 unit 2002. When an actual bit rate of a bitstram is higher than a preset bit rate, the USAC 3D decoder may operate as in FIG. 19. However, when the bit rate of the bitstream is lower than the preset bit rate, the USAC 3D decoder may operate as in FIG. 20.

As described in FIG. 18, an MPS 2-1-2 unit 2002, an MPS 2-1-2 unit 2003 and an MPS 2-1-2 unit 2004 may upmix an input mono signal to output a stereo signal formed of two channel signals using the OTT structure.

In FIG. 20, operations of the MPS 2-1-2 unit 2002 and the MPS 2-1-2 unit 2003 may correspond to consecutive OTT upmixing processes shown in FIGS. 14 and 15. Likewise, operations of the MPS 2-1-2 unit 2002 and the MPS 2-1-2 unit 2004 may correspond to consecutive OTT upmixing processes.

To sum up, in FIG. 18, when the bit rate of the bitstream is lower than the preset bit rate, a residual signal is not generated, and stereo SBR is disabled, the USAC 3D decoder of FIG. 18 operating in QPE mode may produce the same result as that of consecutively performing the OTT upmixing process. That is, the USAC 3D decoder operating of FIG. 18 in QPE mode may consecutively apply OTT upmixing to the mono signal, thereby generating four channel signals, mps_out_L_1, mps_out_L_2, mps_out_R_1 and mps_out_R_2, among N channel signals to finally generate.

A method of encoding a multi-channel signal according to an embodiment may include outputting a first channel signal and a second channel signal by downmixing four channel signals using a first TTO downmixing unit and a second TTO downmixing unit; outputting a third channel signal by downmixing the first channel signal and the second channel signal using a third TTO downmixing unit; and generating a bitstream by encoding the third channel signal.

The outputting of the first channel signal and the second channel signal may output the first channel signal and the second channel signal by downmixing a channel signal pair forming the four channel signals using the first TTO downmixing unit and the second TTO downmixing unit disposed in parallel.

The generating of the bitstream may include extracting a core band of the third channel signal corresponding to a low-frequency band by removing a high-frequency band; and encoding the core band of the third channel signal.

A method of encoding a multi-channel signal according to another embodiment may include generating a first channel signal by downmixing two channel signals using a first TTO downmixing unit; generating a second channel signal by downmixing two channel signals using a second TTO downmixing unit; and stereo-encoding the first channel signal and the second channel signal.

One of the two channel signals downmixed by the first downmixing unit and one of the two channel signals downmixed by the second downmixing unit may be swapped channel signals.

One of the first channel signal and the second channel signal may be a swapped channel signal.

One of the two channel signals downmixed by the first downmixing unit may be generated by a first stereo SBR unit, another thereof may be generated by a second stereo SBR unit, one of the two channel signals downmixed by the second downmixing unit may be generated by the first stereo SBR unit, and another thereof may be generated by the second stereo SBR unit.

A method of decoding a multi-channel signal according to an embodiment may include extracting a first channel signal by decoding a bitstream; outputting a second channel signal and a third channel signal by upmixing the first channel signal using a first OTT upmixing unit; outputting two channel signals by upmixing the second channel signal using a second OTT upmixing unit; and outputting two channel signals by upmixing the third channel signal using a third OTT upmixing unit.

The outputting of the two channel signals by upmixing the second channel signal may upmix the second channel signal using a decorrelation signal corresponding to the second channel signal, and the outputting of the two channel signals by upmixing the third channel signal may upmix the third channel signal using a decorrelation signal corresponding to the third channel signal.

The second OTT upmixing unit and the third OTT upmixing unit may be disposed in parallel to independently conduct upmixing.

The extracting of the first channel signal by decoding the bitstream may include reconstructing the first channel signal of a core band corresponding to a low-frequency band by decoding the bitstream; and reconstructing a high-frequency band of the first channel signal by expanding the core band of the first channel signal.

A method of decoding a multi-channel signal according to another embodiment may include reconstructing a mono signal by decoding a bitstream; outputting a stereo signal by upmixing the mono signal in an OTT manner; and outputting four channel signals by upmixing a first channel signal and a second channel signal forming the stereo signal in a parallel OTT manner.

The outputting of the four channel signals may output the four channel signals by upmixing in the OTT manner using the first channel signal and a decorrelation signal corresponding to the first channel signal and by upmixing in the OTT manner using the second channel signal and a decorrelation signal corresponding to the second channel signal.

A method of decoding a multi-channel signal according to still another embodiment may include outputting a first downmixed signal and a second downmixed signal by decoding a channel pair element using a stereo decoding unit; outputting a first upmixed signal and a second upmixed signal by upmixing the first downmixed signal using a first upmixing unit; and outputting a third upmixed signal and a fourth upmixed signal by upmixing the second downmixed signal which is swapped using a second upmixing unit.

The method may further include reconstructing high-frequency bands of the first upmixed signal and the third upmixed signal which is swapped using a first band extension unit; and reconstructing high-frequency bands of the second upmixed signal which is swapped and the fourth upmixed signal using a second band extension unit.

A method of decoding a multi-channel signal according to yet another embodiment may include outputting a first downmixed signal and a second downmixed signal by decoding a first channel pair element using a first stereo decoding unit; outputting a first residual signal and a second residual signal by decoding a second channel pair element using a second stereo decoding unit; outputting a first upmixed signal and a second upmixed signal by upmixing the first downmixed signal and the first residual signal which is swapped using a first upmixing unit; and outputting a third upmixed signal and a fourth upmixed signal by upmixing the second downmixed signal which is swapped and the second residual signal using a second upmixing unit.

A multi-channel signal encoder according to an embodiment may include a first downmixing unit to output a first channel signal by downmixing a pair of two channel signals among four channel signals in the TTO manner; a second downmixing unit to output a second channel signal by downmixing a pair of remaining channel signals among the four channel signals in the TTO manner; a third downmixing unit to output a third channel signal by downmixing the first channel signal and the second channel signal in the TTO manner; and an encoding unit to generate a bitstream by encoding the third channel signal.

A multi-channel signal decoder according to an embodiment may include a decoding unit to extract a first channel signal by decoding a bitstream; a first upmixing unit to output a second channel signal and a third channel signal by upmixing the first channel signal in the OTT manner; a second upmixing unit to output two channel signals by upmixing the second channel signal in the OTT manner; and a third upmixing unit to output two channel signals by upmixing the third channel signal in the OTT manner.

A multi-channel signal decoder according to another embodiment may include a decoding unit to reconstruct a mono signal by decoding a bitstream; a first upmixing unit to output a stereo signal by upmixing the mono signal in the OTT manner; a second upmixing unit to output two channel signals by upmixing a first channel signal forming the stereo signal; and a third upmixing unit to output two channel signals by upmixing a second channel signal forming the stereo signal, wherein the second upmixing unit and the third upmixing unit are disposed in parallel to upmix the first channel signal and the second channel signal in the OTT manner to output four channels signals.

A multi-channel signal decoder according to still another embodiment may include a stereo decoding unit to output a first downmixed signal and a second downmixed signal by decoding a channel pair element; a first upmixing unit to output a first upmixed signal and a second upmixed signal by upmixing the first downmixed signal; and a second upmixing unit to output a third upmixed signal and a fourth upmixed signal by upmixing the second downmixed signal which is swapped.

The embodiments of the present invention may include configurations as follows.

A method of encoding a multi-channel signal according to an embodiment may include generating M channel signals and additional information by encoding N channel signals; and outputting a bitstream by encoding the M channel signals.

When N is an even number, M may be N/2.

The generating of the M channel signals and the additional information by encoding the N channel signals may include grouping the N channel signals into pairs of two channel signals; and downmixing the grouped two channel signals into a single channel signal to output the M channel signals.

The additional information may include a spatial cue generated by downmixing the N channel signals.

When N is an odd number, M may be (N−1)/2+1.

The generating of the M channel signals and the additional information by encoding the N channel signals may include grouping the N channel signals into pairs of two channel signals; downmixing the grouped two channel signals into a single channel signal to output (N−1)/2 channel signals; and delaying an ungrouped channel signal among the N channel signals.

The delaying of the ungrouped channel signal may delay the ungrouped channel signal considering a delay time occurring when the grouped two channel signals are downmixed into the single channel signal to output the (N−1)/2 channel signals.

When N is N'+K and N' is an even number, M may be N'/2+K.

The method may include grouping N' channel signals into pairs of two channel signals; downmixing the grouped two channel signals to output N'/2 channel signals; and delaying K ungrouped channel signals.

When N is N'+K and N' is an odd number, M may be (N'−1)/2+1+K.

The method may include grouping N' channel signals into pairs of two channel signals; downmixing the grouped two channel signals to output (N'−1)/2 channel signals; and delaying K ungrouped channel signals.

A method of decoding a multi-channel signal according to an embodiment may include decoding M channel signals and additional information from a bitstream, and outputting N channel signals using the M channel signals and the additional information.

When N is an even number, N may be M*2.

The outputting of the N channel signals may include generating M decorrelation signals using the M channel signals; and outputting the N channel signals by upmixing the additional information, the M channel signals and the M decorrelation signals.

When N is an odd number, N may be (M−1)*2+1.

The outputting of the N channel signals may include delaying one channel signal among the M channel signals; generating (M−1) decorrelation signals using (M−1) non-delayed channel signals among the M channel signals; and outputting (M−1)*2 channel signals by upmixing the (M−1) channel signals and the (M−1) decorrelation signals as additional information.

The decoding of the M channel signals and the additional information may group the M decoded channel signals into K channel signals and remaining channel signals when N is N'+K.

A multi-channel signal encoder according to an embodiment may include a first encoding unit to generate M channel signals and additional information by encoding N channel signals; and a second encoding unit to output a bitstream by encoding the M channel signals.

A multi-channel signal decoder according to an embodiment may include a first decoding unit to decode M channel signals and additional information from a bitstream; and a second decoding unit to output N channel signals using the M channel signals and the additional information.

The units described herein may be implemented using hardware components, software components, and/or combinations of hardware components and software components. For instance, the units and components illustrated in the embodiments may be implemented using one or more general-purpose or special purpose computers, such as, for example, a processor, a controller, an arithmetic logic unit (ALU), a digital signal processor, a microcomputer, a field programmable array (FPA), a programmable logic unit (PLU), a microprocessor or any other device capable of responding to and executing instructions. A processing device may run an operating system (OS) and one or more software applications that run on the OS. The processing device also may access, store, manipulate, process, and create data in response to execution of the software. For purpose of simplicity, the description of a processing device is used as singular; however, one skilled in the art will appreciated that a processing device may include multiple processing elements and multiple types of processing elements. For example, a processing device may include multiple processors or a processor and a controller. In addition, different processing configurations are possible, such as parallel processors.

The software may include a computer program, a piece of code, an instruction, or one or more combinations thereof, to independently or collectively instruct or configure the processing device to operate as desired. Software and/or data may be embodied permanently or temporarily in any type of machine, component, physical or virtual equipment, computer storage medium or device, or in a propagated signal wave in order to provide instructions or data to the processing device or to be interpreted by the processing device. The software may also be distributed over network coupled computer systems so that the software is stored and executed in a distributed fashion. The software and data may be stored by one or more non-transitory computer readable recording mediums.

The methods according to the embodiments may be realized as program instructions implemented by various computers and be recorded in non-transitory computer-readable media. The media may also include, alone or in combination with the program instructions, data files, data structures, and the like. The program instructions recorded in the media may be designed and configured specially for the embodiments or be known and available to those skilled in computer software. Examples of the non-transitory computer readable recording medium may include magnetic media such as hard disks, floppy disks, and magnetic tape; optical media such as CD ROM disks and DVDs; magneto-optical media such as floptical disks; and hardware devices that are specially configured to store and perform program instructions, such as read-only memory (ROM), random access memory (RAM), flash memory, and the like. Examples of program instructions include both machine codes, such as produced by a compiler, and higher level language codes that may be executed by the computer using an interpreter. The described hardware devices may be configured to act as one or more software modules in order to perform the operations of the above-described exemplary embodiments, or vice versa.

While a few exemplary embodiments have been shown and described with reference to the accompanying drawings, it will be apparent to those skilled in the art that various modifications and variations can be made from the foregoing descriptions. For example, adequate effects may be achieved even if the foregoing processes and methods are carried out in different order than described above, and/or the aforementioned elements, such as systems, structures, devices, or circuits, are combined or coupled in different forms and modes than as described above or be substituted or switched with other components or equivalents. Thus, other implementations, alternative embodiments and equivalents to the claimed subject matter are construed as being within the appended claims.

The invention claimed is:

1. A decoding method comprising:

outputting, by a core decoding unit, a mono signal of a core band corresponding to a low-frequency band from a bitstream;

generating, by a first upmixinq unit, a stereo signal including a first channel signal and a second channel signal from the mono signal of the core band; and generating a four-channel signal, by a second upmixinq unit and a third upmixinq unit from the stereo signal including the first channel signal and the second channel signal, wherein the first channel signal of the stereo signal outputted from the first upmixinq unit is inputted into the second upmixinq unit, and the second channel signal of the stereo signal outputted from the first upmixinq unit is inputted into the third upmixinq unit, wherein the second upmixinq unit and the third upmixinq unit generate the four-channel signal using the first channel signal and the second channel signal.

2. The method of claim 1, wherein the second upmixinq unit and the third upmixinq unit is disposed in parallel.

3. The method of claim 1, wherein the core band is reconstructed to a high-frequency band by a SBR unit.

* * * * *